US009341438B2

(12) United States Patent
Larson, Jr.

(10) Patent No.: US 9,341,438 B2
(45) **Date of Patent: *May 17, 2016**

(54) HANDGUARD FOR FIREARM

(71) Applicant: Rock River Arms, Inc., Colona, IL (US)

(72) Inventor: Lester C. Larson, Jr., Colona, IL (US)

(73) Assignee: Rock River Arms, Inc., Colona, IL (US)

( * ) Notice: Subject to any disclaimer, the term of this patent is extended or adjusted under 35 U.S.C. 154(b) by 79 days.

This patent is subject to a terminal disclaimer.

(21) Appl. No.: 14/593,575

(22) Filed: Jan. 9, 2015

(65) Prior Publication Data

US 2015/0323284 A1 Nov. 12, 2015

Related U.S. Application Data

(63) Continuation of application No. 14/181,256, filed on Feb. 14, 2014, now Pat. No. 8,931,197, which is a continuation-in-part of application No. 13/937,597, filed on Jul. 9, 2013, now Pat. No. 8,959,820.

(60) Provisional application No. 61/671,330, filed on Jul. 13, 2012.

(51) Int. Cl.

| | |
|---|---|
| ***F41C 23/16*** | (2006.01) |
| ***F41A 3/66*** | (2006.01) |
| ***F41A 21/00*** | (2006.01) |

(52) U.S. Cl.

CPC . *F41C 23/16* (2013.01); *F41A 3/66* (2013.01); *F41A 21/00* (2013.01)

(58) Field of Classification Search

CPC ..... F41A 21/44; F41A 36/00; F41C 23/16
USPC ..... 42/71.01, 72, 85, 90, 96, 114; 89/14.1; D22/108, 109; 16/422, 426, 427
See application file for complete search history.

(56) References Cited

U.S. PATENT DOCUMENTS

| | | | |
|---|---|---|---|
| 897,577 | A | 9/1908 | Bourne |
| 1,321,173 | A | 11/1919 | Wilson |
| 1,768,372 | A | 6/1930 | Powell |
| 2,425,245 | A | 8/1947 | Johnson |
| 2,447,229 | A | 8/1948 | Bradley |
| 2,480,135 | A | 8/1949 | Harbey |
| 2,563,923 | A | 8/1951 | Crosby |
| 2,771,697 | A | 11/1956 | Reising |
| 2,826,848 | A | 3/1958 | Davies |
| 3,242,608 | A | 3/1966 | Heppard |
| 3,367,054 | A | 2/1968 | Loffler et al. |
| 3,623,257 | A | 11/1971 | Ray |
| 3,682,023 | A | 8/1972 | Greene, Jr. |
| 3,685,194 | A | 8/1972 | Coon |
| 5,068,992 | A | 12/1991 | Velezis et al. |
| 5,198,600 | A | 3/1993 | E'Nama |
| 5,417,002 | A | 5/1995 | Guerra |

(Continued)

*Primary Examiner* — Bret Hayes
(74) *Attorney, Agent, or Firm* — Banner & Witcoff, Ltd.

(57) ABSTRACT

A handguard or other cover for a firearm includes a shell or body with a hollow interior cavity and a retaining structure configured to engage the forearm and retain the shell in place on the forearm, where the retaining structure is releasable to permit removal of the shell from the forearm. The shell may have a concave inner surface and a convex outer surface extending between the first and second edges. The concave inner surface may include at least one tab extending outwardly from the inner surface which is configured to be connected to a slot or opening formed in the forearm for the firearm.

20 Claims, 25 Drawing Sheets

(56) References Cited

U.S. PATENT DOCUMENTS

| | | | | |
|---|---|---|---|---|
| 5,590,484 | A | 1/1997 | Mooney et al. | |
| 6,374,528 | B1 | 4/2002 | Davis et al. | |
| 6,609,321 | B2 | 8/2003 | Faifer | |
| 6,655,069 | B2 | 12/2003 | Kim | |
| 6,698,127 | B2 | 3/2004 | Weber | |
| 6,779,288 | B1 | 8/2004 | Kim | |
| D555,224 | S | 11/2007 | Florea et al. | |
| D615,142 | S | 5/2010 | Bentley | |
| 7,775,150 | B2 | 8/2010 | Hochstrate et al. | |
| 7,861,380 | B2 | 1/2011 | Moore et al. | |
| 7,934,447 | B2 | 5/2011 | Kuczynko et al. | |
| 7,938,055 | B2 | 5/2011 | Hochstrate et al. | |
| 8,020,334 | B2 | 9/2011 | Delmonico | |
| 8,117,958 | B2 | 2/2012 | Hochstrate et al. | |
| 8,201,353 | B1 | 6/2012 | Swan | |
| D672,838 | S | 12/2012 | Mayberry et al. | |
| 8,782,942 | B1 | 7/2014 | Bentley | |
| 8,931,197 | B2 * | 1/2015 | Larson | 42/71.01 |
| 8,959,820 | B2 * | 2/2015 | Larson, Jr. | 42/71.01 |
| 2005/0011050 | A1 | 1/2005 | Ogg | |
| 2006/0191183 | A1 | 8/2006 | Griffin | |
| 2007/0137087 | A1 | 6/2007 | Florea et al. | |
| 2007/0181114 | A1 | 8/2007 | Tippmann et al. | |
| 2008/0092422 | A1 | 4/2008 | Daniel et al. | |
| 2009/0038198 | A1 | 2/2009 | Yu | |
| 2009/0241397 | A1 | 10/2009 | Fitzpatrick et al. | |
| 2009/0277069 | A1 | 11/2009 | Delmonico | |
| 2010/0126054 | A1 | 5/2010 | Daniel et al. | |
| 2010/0154280 | A1 | 6/2010 | LaFrance et al. | |
| 2010/0192444 | A1 | 8/2010 | Cabahug et al. | |
| 2010/0212201 | A1 | 8/2010 | Kincel et al. | |
| 2010/0236124 | A1 | 9/2010 | Troy | |
| 2011/0119982 | A1 | 5/2011 | Webber et al. | |
| 2011/0271827 | A1 | 11/2011 | Larson et al. | |
| 2012/0036756 | A1 | 2/2012 | Brown | |
| 2012/0246989 | A1 | 10/2012 | Troy | |
| 2012/0266514 | A1 | 10/2012 | Michal et al. | |
| 2012/0324775 | A1 | 12/2012 | Troy et al. | |
| 2013/0276344 | A1 | 10/2013 | Picciotta et al. | |

* cited by examiner 33
35
34
36
39
40
48
330
31
32
37
38

HANDGUARD FOR FIREARM

CROSS-REFERENCE TO RELATED APPLICATION

This application is a continuation of U.S. application Ser. No. 14/181,256, filed Feb. 14, 2014, now U.S. Pat. No. 8,931,197, which is a continuation-in-part application of U.S. application Ser. No. 13/937,597, filed Jul. 9, 2013, which claims priority to U.S. Provisional Application Ser. No. 61/671,330, filed Jul. 13, 2012, each of which is incorporated herein by reference.

TECHNICAL FIELD

The present invention generally relates to a handguard for a firearm and, more particularly, to a handguard with a retaining structure that can removably connect the handguard cover to a forearm of a rifle or other long gun.

BACKGROUND

The use of handguards on firearms, such as rifles, carbines, shotguns, and other long guns, is known. Such handguards may be made of wood, metal, plastic, or other materials or combinations of materials. Additionally, such handguards may have various functionalities depending on their design, including providing a gripping surface for the user, protecting the user from barrel heat, dissipating heat, providing connections for mounting of accessories, providing a desired visual appearance, etc. However, one drawback to existing handguards is lack of easy customizability, such as to achieve different functionality and/or appearance. Changing handguards can often be complicated and/or time consuming. The present invention seeks to overcome certain of these limitations and other drawbacks of the prior art, and to provide new features not heretofore available.

BRIEF SUMMARY

The present invention relates generally to a handguard or other cover for a firearm. Aspects of the invention relate to a handguard or other cover for a firearm that includes a body or shell with a hollow interior cavity and a retaining structure configured to engage the forearm and retain the shell in place on the forearm, where the retaining structure is releasable to permit removal of the shell from the forearm. The shell extends axially between first and second ends and peripherally between first and second edges around an angular range greater than 180° and less than 360° to define the shell in a semi-tubular shape, such that the shell has a concave inner surface and a convex outer surface extending between the first and second edges. The first edge is spaced from the second edge to define a gap providing access to the interior cavity, and the shell is configured to be connected to a forearm for the firearm by inserting the forearm within the interior cavity. The shell further has end openings at the first and second ends providing access to the interior cavity. The shell may further have a semi-circular outer periphery and/or inner periphery when viewed in cross-section.

According to one aspect, the retaining structure further includes a first tab and a second tab located on the inner surface of the shell. The first tab and the second tab are located on opposite sides of the interior cavity, such that the first and second tabs are configured to be received in slots in the forearm to removably connect the shell to the forearm. The first tab may be located approximately 180° around the inner surface of the shell from the second tab. The retaining structure may further include a third tab and a fourth tab positioned on the inner surface of the shell. The third tab may be aligned along a first linear axis with the first tab and the fourth tab may be aligned along a second linear axis with the second tab, such that the third tab is located approximately 180° around the inner surface of the shell from the fourth tab. The third and fourth tabs are configured to be received in additional slots in the forearm to removably connect the shell to the forearm.

According to another aspect, the shell is elongated along an axial direction between a first end and a second end, and the removable handguard further includes a mounting structure connected to the shell and configured for mounting an accessory. The mounting structure may include a first rail connected to the outer surface of the shell and running in the axial direction over at least a portion of an axial length of the shell. The first rail is configured for mounting of an accessory. The first rail may be positioned along a bottom of the shell, opposite the gap, and may run along the entire axial length of the shell. The shell may also include a gripping section extending along a first portion of the axial length and a mounting section extending along a second portion of the axial length. In this configuration, the gripping section is configured for gripping by a user, and the mounting section includes the first rail, where the first rail extends along the entire second portion of the axial length. Further, the gripping section may extend in the axial direction from the first end to a point between the first and second ends, and the mounting portion may extend in the axial direction from that point to the second end. Still further, the shell may include at least a second rail positioned at approximately 90° or 180° around the outer surface of the shell from the first rail.

Additional aspects of the invention relate to a handguard or other cover for a firearm that includes a semi-tubular body having a C-shaped cross-section with a hollow interior, an outer surface opposite the hollow interior, and two edges separated by a gap that provides access to the hollow interior, as well as a pair of retaining tabs projecting inwardly from interior surfaces of the body, the retaining tabs configured to engage slots on the firearm to connect the body to the firearm. The body is elongated between a first and a second end in an axial direction perpendicular to the C-shaped cross-section. The body further has end openings at the first and second ends providing access to the hollow interior.

According to one aspect, the body further includes a second pair of retaining tabs projecting inwardly from interior surfaces of the body, the second pair of retaining tabs being axially spaced from the pair of retaining tabs and axially aligned with the pair of retaining tabs.

According to another aspect, the retaining tabs are positioned on opposite sides of the hollow interior and are spaced approximately equal distances from the two edges.

According to a further aspect, the cover further includes a first rail connected to the outer surface of the body and running in the axial direction over at least a portion of an axial length of the body, the first rail configured for mounting of accessories. The cover may further include second and third rails connected to the outer surface of the body and running in the axial direction over at least a portion of the axial length of the body, where the second and third rails are also configured for mounting of an accessory. In one configuration, the first rail extends along a bottom of the body opposite the gap, and the second and third rails extend along left and right sides of the body, respectively. The first, second, and third rails may all extend the entire axial length of the body. Alternately, the first, second, and third rails may all extend a portion of the axial length of the body, where a second portion of the axial length of the body has a rounded contour and grip-enhancing features. The rails may extend different lengths in another configuration.

According to yet another aspect, the body has the C-shaped cross-section over an entire axial length of the body, from the first end to the second end. The shape of the C-shaped cross-section may vary along the axial length of the body, such that the body has a first C-shaped cross-sectional shape in a first portion of the body and a second C-shaped cross-sectional shape in a second portion of the body.

Further aspects of the invention relate to a removable handguard or other cover for a firearm, including a semi-tubular body having a C-shaped cross-section with a hollow interior cavity, and a first retaining tab and a second retaining tab located on the inner surface of the body and projecting inwardly from the inner surface. The body has a concave inner surface and a convex outer surface extending peripherally between first and second edges around an angular range greater than 180° and less than 360° to define the C-shaped cross-section, where the first edge is spaced from the second edge to define a gap providing access to the interior cavity. The body is elongated between a first and a second end in an axial direction perpendicular to the C-shaped cross-section, and has end openings at the first and second ends providing access to the interior cavity. The body is configured to be connected to a forearm for the firearm by inserting the forearm within the interior cavity such that portions of the firearm extend through the gap and the end openings. The first retaining tab and the second retaining tab are located on opposite sides of the interior cavity such that the first tab is located approximately 180° around the inner surface of the body from the second tab. The first and second retaining tabs are configured to be received in slots in the forearm to removably connect the body to the forearm, and the first and second retaining tabs are releasable to permit removal of the body from the forearm.

According to one aspect, the handguard further includes a first rail connected to the outer surface of the body on the bottom side of the body opposite the gap, a second rail connected to the outer surface of the body on a left side of the body approximately 90° to the left of the first rail, and a third rail connected to the outer surface of the body on a right side of the body approximately 90° to the right of the first rail. The first rail runs in the axial direction and has a length that is at least a portion of an axial length of the body. The second and third rails run the same length as the first rail in the axial direction. The rails are each configured for mounting of accessories. The length of the first rail may be approximately equal to the axial length of the body and the first, second, and third rails may therefore extend from the first end to the second end of the body. Alternately, the length of the first rail may be less than half the axial length of the body, and the first, second, and third rails may extend from the first end toward the second end over less than half the axial length of the body.

According to another aspect, a shape of the C-shaped cross-section varies along the axial length of the body, such that the body has a first C-shaped cross-sectional shape in a first portion of the body including the first, second, and third rails, and a second C-shaped cross-sectional shape in a second portion of the body. The outer surface of the body is smoothly rounded with gripping ridges in the second C-shaped cross-sectional shape. The first portion may extend in the axial direction from the first end to a point between the first and second ends, and the second portion may extend in the axial direction from that point to the second end.

According to a further aspect, a third retaining tab and a fourth retaining tab are located on the inner surface of the body and project inwardly from the inner surface. The third retaining tab and the fourth retaining tab are located on opposite sides of the interior cavity such that the third tab is located approximately 180° around the inner surface of the body from the fourth tab. The third retaining tab is axially aligned with and axially spaced from the first retaining tab and the fourth retaining tab is axially aligned with and axially spaced from the second retaining tab.

Still further aspects of the invention relate to a firearm having a handguard as described above attached thereto. The firearm may include a receiver assembly, a free-floating barrel connected to the receiver assembly, a muzzle at the end of the barrel, and the forearm at least partially surrounding the barrel and positioned between the receiver assembly and the muzzle. The forearm may have a pair of slots on opposite sides thereof, and the handguard may be connected to the forearm such that the forearm is at least partially received in the interior cavity and the first and second retaining tabs are received in the pair of slots to connect the removable handguard to the forearm.

Other aspects of the invention relate to a method that includes connecting a handguard as described above to a firearm. The method may also include removing the handguard from the firearm, as well as optionally replacing the handguard with another handguard. The replacement handguard may have a different visual appearance and/or a different functionality (e.g. gripping configuration, mounting configuration, etc.).

Still other features and advantages of the invention will be apparent from the following specification taken in conjunction with the following drawings.

DETAILED DESCRIPTION

Figure 1:
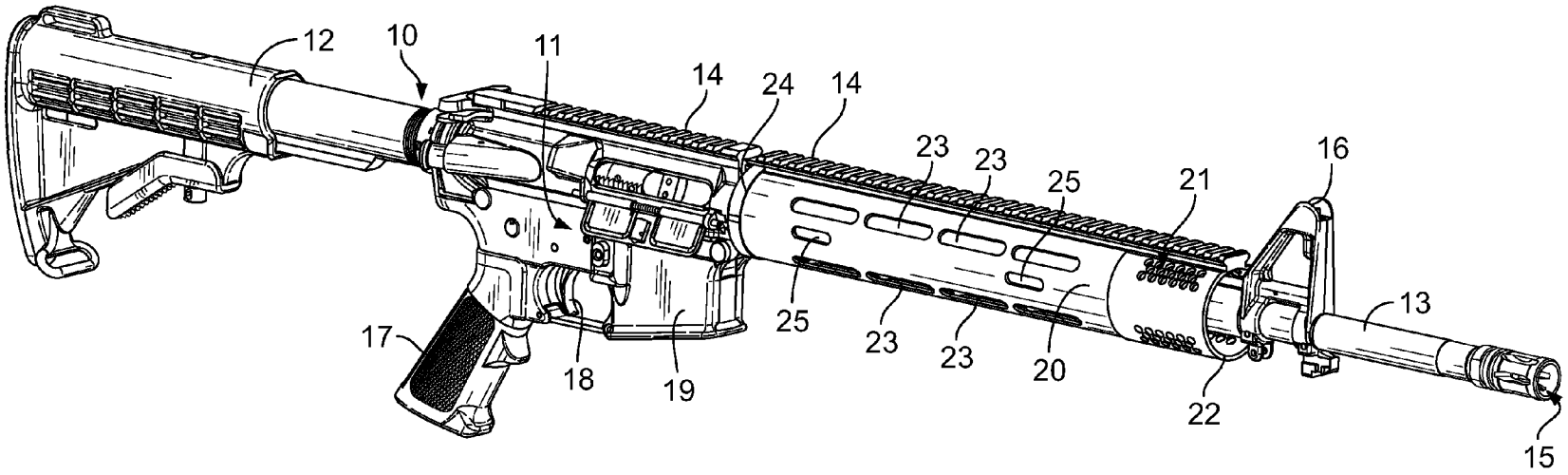
FIG. 1 is a perspective view of a firearm, in the form of a military style rifle.

While this invention is susceptible of embodiment in many different forms, there are shown in the drawings, and will herein be described in detail, preferred embodiments of the invention with the understanding that the present disclosure is to be considered as an exemplification of the principles of the invention and is not intended to limit the broad aspects of the invention to the embodiments illustrated and described.

Figure 2:
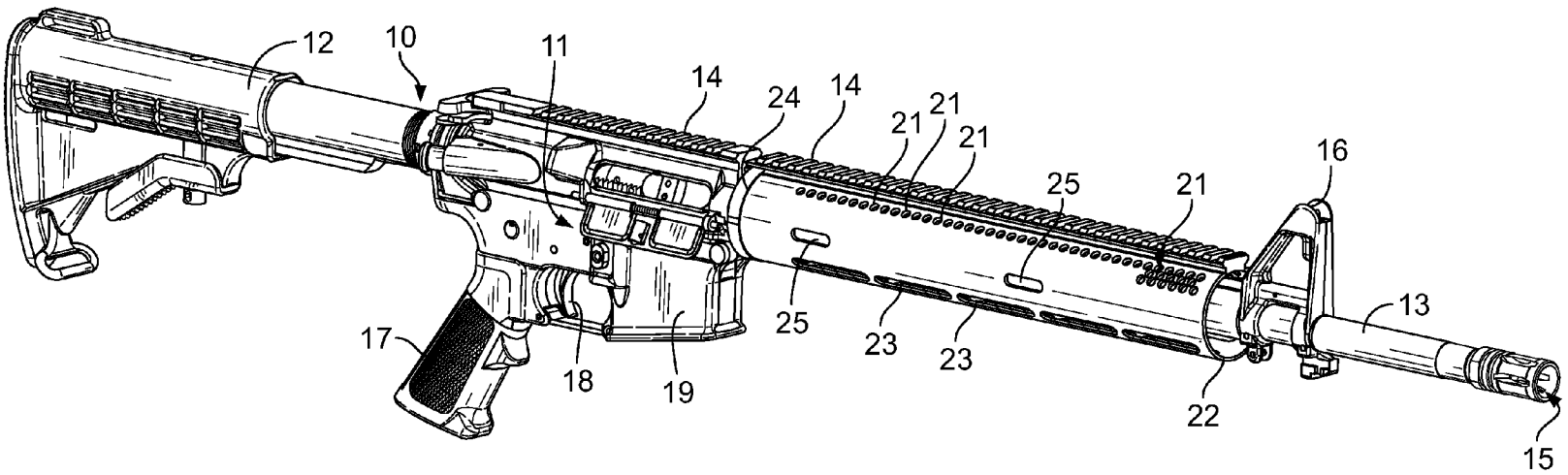
FIG. 2 is a perspective view of another firearm, in the form of a military style rifle.

FIGS. 1 and 2 illustrate examples of a firearm 10 that may be used in connection with aspects of the present invention. The firearm 10 illustrated in FIGS. 1 and 2 is in the form of a military or tactical style rifle, such as an AR-15, M-16, M-4, etc. The firearm 10 generally includes a receiver assembly 11, a buttstock 12 connected to the rear of the receiver assembly 11, a barrel 13 connected to the front of the receiver assembly 11, and a forearm or forestock 20 (which may alternately be referred to as a "handguard" in the art). The receiver assembly 11 may include a firing mechanism and other components known in the art, such as a bolt, a charging handle, etc. The barrel 13 in this embodiment is a free-floating barrel that is connected to the receiver assembly 11 and is supported only by the connection to the receiver assembly, but a different type of barrel 13 may be used in other embodiments. The barrel 13 has a muzzle 15 at the tip. The forearm 20 is connected to the barrel 13 and/or the receiver assembly 11 and covers a portion of the length of the barrel 13 between the receiver assembly 11 and the muzzle 15. In one embodiment, the forearm 20 connects to the firearm 10 proximate the receiver assembly, at the rear end of the barrel 13, using a threaded connection with threading inside the forearm 20. In another embodiment, the forearm 20 may not completely cover the barrel 13, and, for example, may cover or be positioned adjacent one or more sides of the barrel 13. The firearm 10 may also include other known components, such as sights 16, a grip 17, a trigger 18, a magazine holder 19 for holding a magazine (not shown), and/or other components. It is understood that the firearm 10 may not include one or more of such components in other embodiments. Aspects of the invention may be utilized in connection with a firearm 10 as illustrated in FIGS. 1 and 2 or another type of firearm, including other types of rifles, shotguns, machine pistols, air rifles, paintball guns, or other firearms with a forearm or forestock.

In the embodiments of FIGS. 1 and 2, the receiver assembly 11 and the forearm 20 each have rails 14 that are configured for mounting of accessories. The rails 14 illustrated in this embodiment are Picatinny rails, but other types or configurations of rails 14 may be used in other embodiments. In alternate embodiments, one or both of the receiver assembly 11 and/or the forearm 20 may not have rails 14, or may have multiple rails 14 or rails that are positioned differently.

The firearms 10 of FIGS. 1 and 2 have forearms 20 that are different. The forearm 20 of FIG. 1 has a group of vent holes 21 near the front end 22 and venting slits 23 around the middle of the forearm 20. The forearm 20 of FIG. 2 also has a group of vent holes 21 near the front end 22 and further includes a row of vent holes 21 extending from proximate the front end 22 to proximate the rear end 24. In other aspects, the forearms 20 of the firearms 10 of FIGS. 1 and 2 are generally similar. Both forearms 20 are connected to the receiver assembly 11 at the rear end 24 and completely surround the barrel 13 for a portion of the length of the barrel 13. As described above, the forearms 20 may be connected to the respective firearms 11 by a threaded connection proximate the receiver assembly 11. Alternately, the forearms 20 may be configured in a split or clamshell design that includes two pieces that are connected together to form a tubular structure around the barrel 13. Additionally, the forearms 20 of FIGS. 1 and 2 both have slots 25 positioned in the outer surface and configured for attachment of a handguard 30, as described below. These slots 25 are depicted in FIGS. 1 and 2 as extending completely through the body of the forearm 20, however in another embodiment, the slots 25 may be recesses in the outer surface. As described above, a firearm 10 with a different type or style of forearm 20 may also be used in connection with the present invention.

Figure 3:
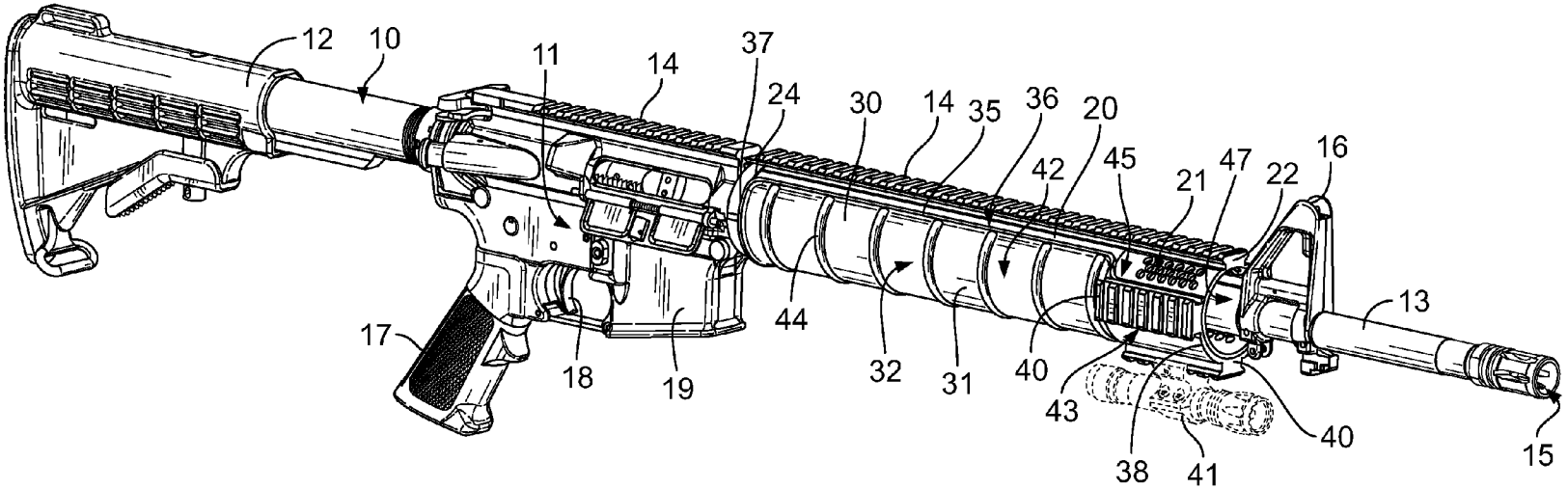
FIG. 3 is a perspective view of the rifle of FIG. 1 with one embodiment of a handguard according to aspects of the present invention connected to a forearm of the rifle.
Figure 4:
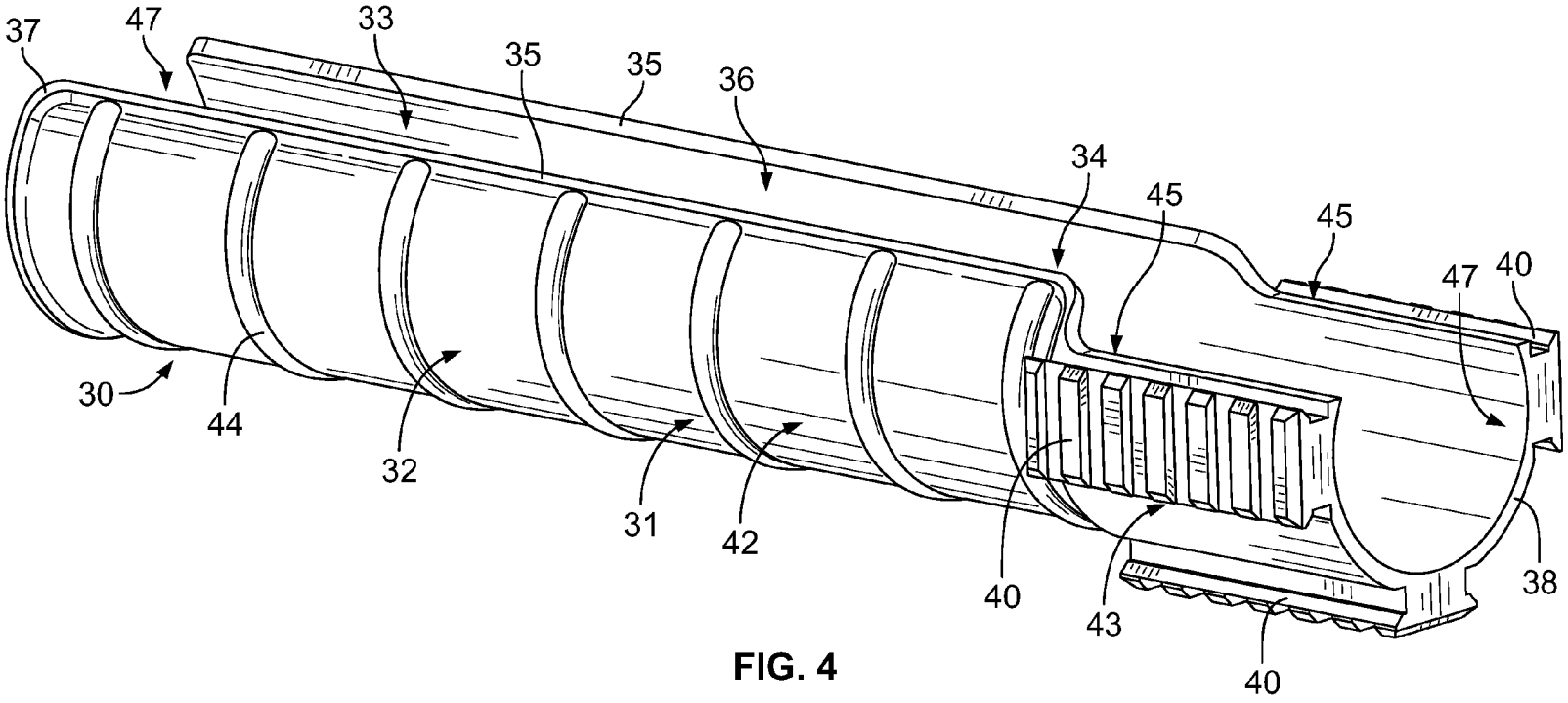
FIG. 4 is a perspective view of the handguard of FIG. 3.
Figure 7:
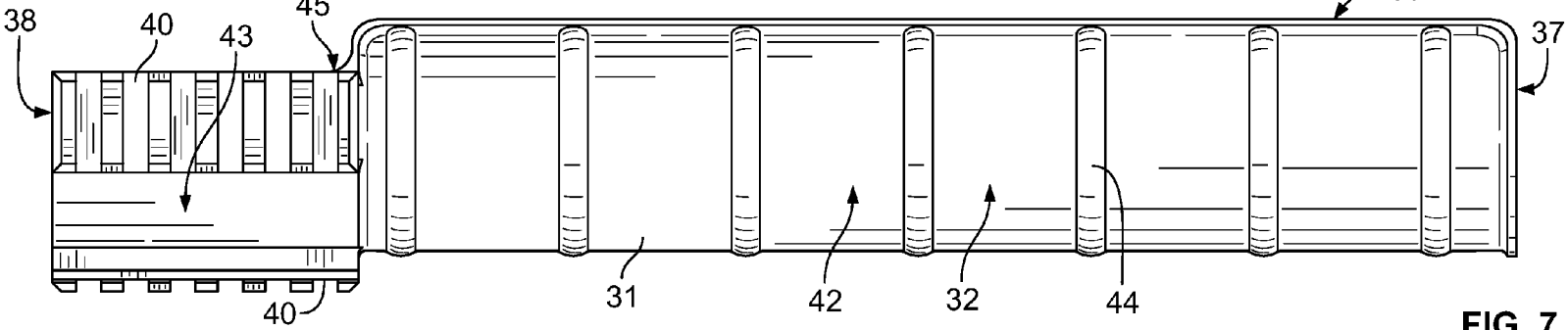
FIG. 7 is a right side view of the handguard of FIG. 4.
Figure 8:
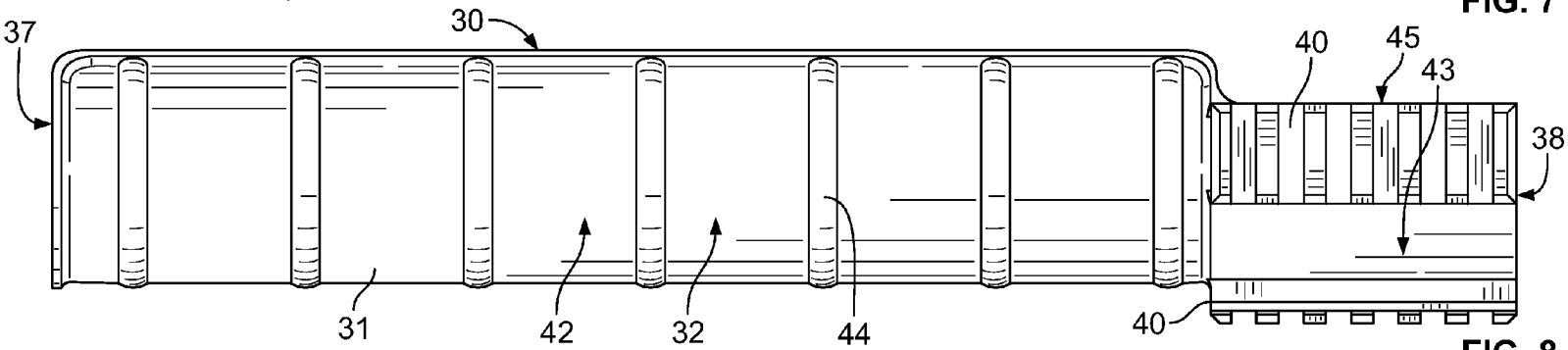
FIG. 8 is a left side view of the handguard of FIG. 4.
Figure 9:
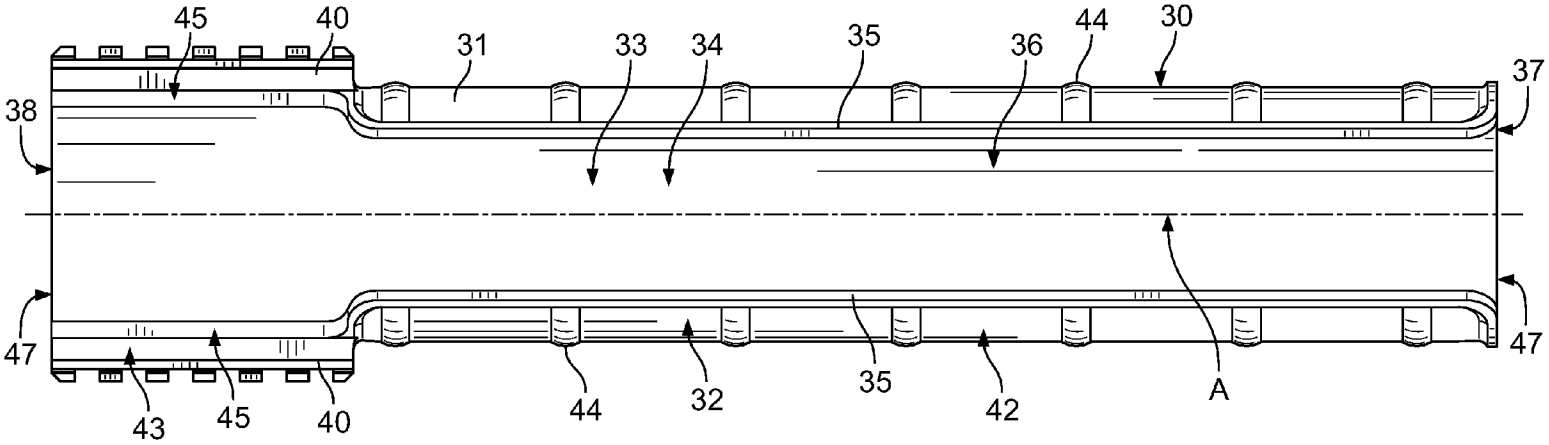
FIG. 9 is a top view of the handguard of FIG. 4.
Figure 10:
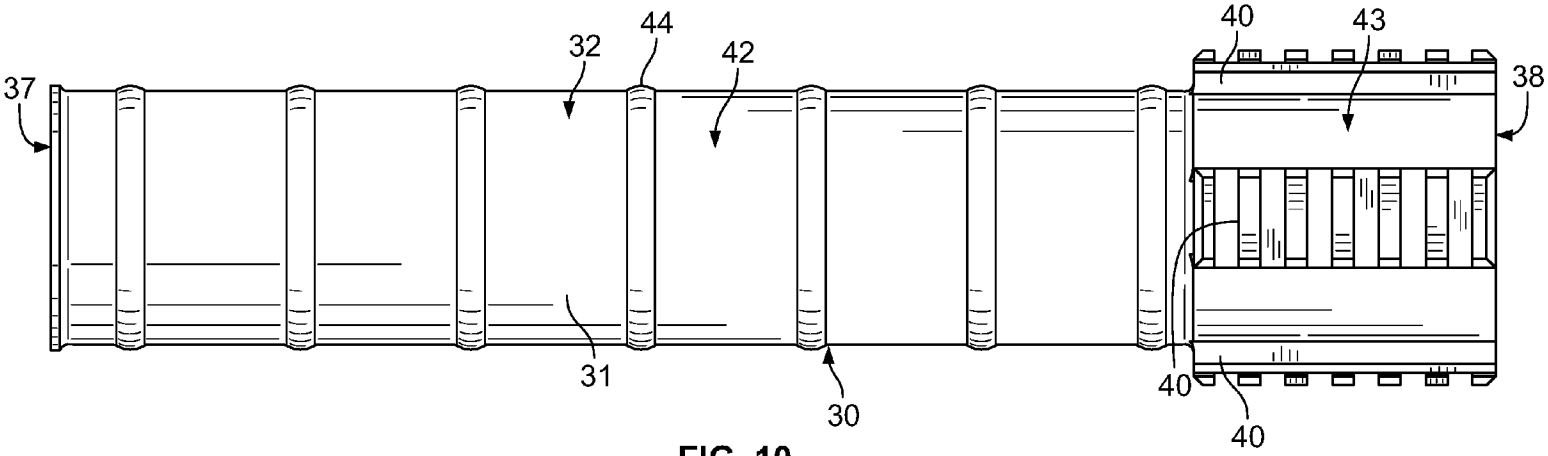
FIG. 10 is a bottom view of the handguard of FIG. 4.
Figure 11:
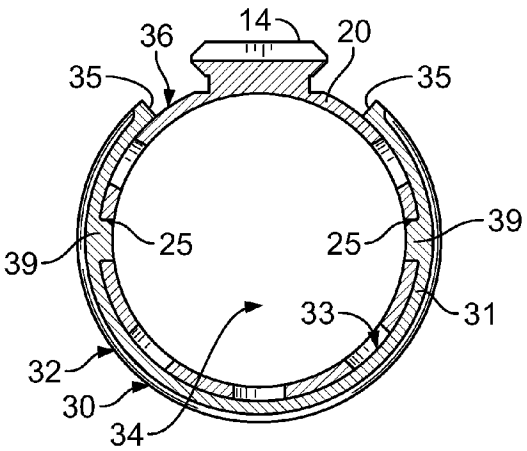
FIG. 11 is a cross-section view of the handguard of FIG. 4, taken normal to the axial direction, shown connected to the forearm of the rifle of FIG. 3.

FIGS. 3-12 illustrate one embodiment of a handguard 30 according to aspects of the present invention. FIG. 3 shows the handguard 30 connected to the firearm 10 of FIG. 1. As illustrated in FIGS. 3-12, the handguard 30 is a single piece structure that has a body 31 in the form of a semi-tubular shell with an outer surface 32, and inner surface 33, and an interior cavity 34 defined within the body 31 and bounded by the inner surface 33. It is understood that the inner surface 33 and/or the outer surface 32, as described herein, may include a plurality of different surfaces, including different contours and surface features. The body 31 of the handguard 30 is elongated along an axis of elongation, which runs in the axial direction A of the semi-tubular body 31, as shown in FIG. 9. The interior cavity 34 is also elongated along the axial direction A. In this embodiment, the outer surface 32 is convex and the inner surface 33 is concave. As used herein, "convex" means that the surface in question is generally convex or outwardly bulbous in overall structure, but does not imply that the surface is smooth and/or curvilinear unless otherwise stated, and allows for various surface contours and features. Similarly, "concave," as used herein, means that the surface in question is generally concave or inwardly recessed in overall structure, but does not imply that the surface is smooth and/or curvilinear unless otherwise stated, and allows for various surface contours and features. As shown in FIGS. 3-8, in this embodiment, the convex outer surface 32 and the concave inner surface 33 are smoothly curved surfaces over a majority of the body 31.

The body 31 of the handguard 30 shown in FIGS. 3-12 is generally C-shaped and/or semi-tubular in shape, having two edges 35 that have a gap 36 defined between them to provide access to the interior cavity 34. In this embodiment, the outer surface 32 and the inner surface 33 both extend between one edge 35 and the other edge 35, and extend around an angular range of at least 180° but less than 360°, to thereby create the gap 36. End openings 47 are defined at the two axial ends 37, 38, which also provide access to the interior cavity 34. The body 31 is configured to receive a portion of the firearm 10 within the interior cavity 34, so that the portion of the firearm 10 enters through one end opening 47 and exits through the other end opening 47. In the configuration shown in FIG. 3, portions of the firearm 10 extend through the gap 36 and through both of the end openings 47. As shown in FIG. 3, in one embodiment, the handguard 30 is configured for connection to the forearm 20 of the firearm 10, and to receive at least a portion of the forearm 20 within the interior cavity 34.

Figure 6:
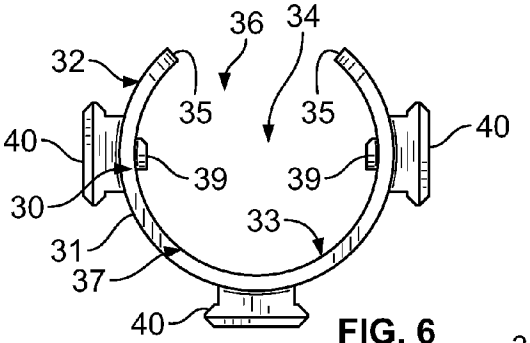
FIG. 6 is a rear view of the handguard of FIG. 4.
Figure 5:
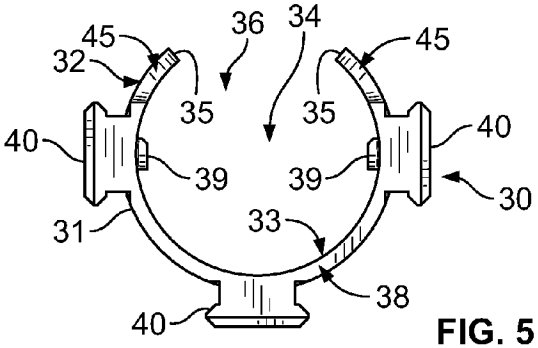
FIG. 5 is a front view of the handguard of FIG. 4.
Figure 12:
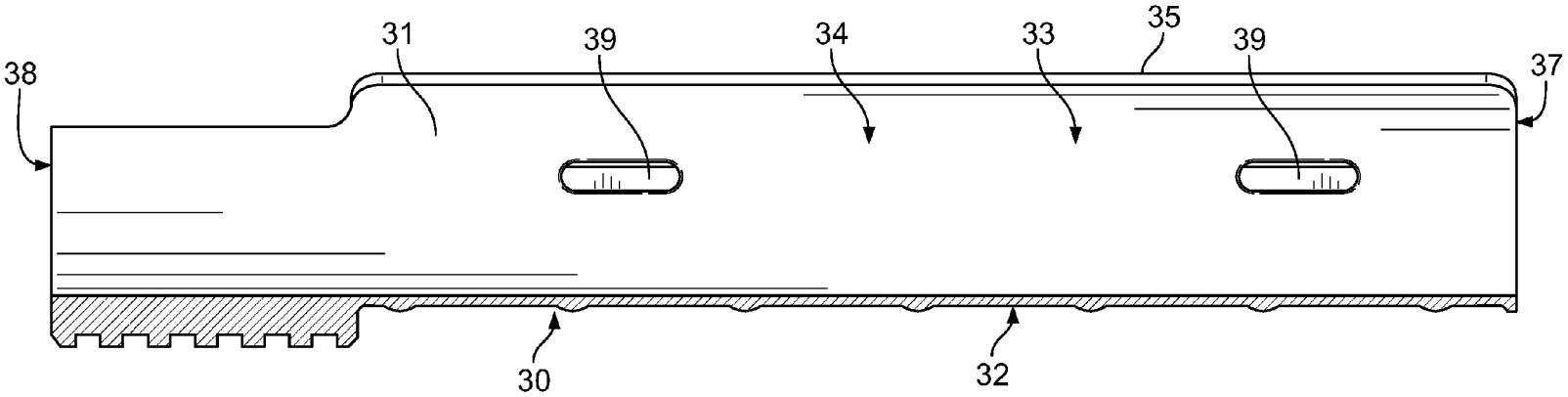
FIG. 12 is a cross-section view of the handguard of FIG. 4, taken along the axial direction.

The handguard 30 may have retaining structure to retain the handguard 30 to the firearm 10, and such retaining structure may be removable/releasable retaining structure to removably retain the handguard 30 to the firearm 10. In the embodiment of FIGS. 3-12, the handguard 30 has retaining structure in the form of retaining tabs 39 located on the inner surface 33 of the body 31. The retaining tabs 39 project inwardly from the inner surface 33 into the interior cavity 34, and may be at least somewhat flexible and/or resilient to aid connection to the firearm 10, as described below. In this embodiment, the handguard 30 contains two pairs of retaining tabs 39, with each pair positioned on opposite sides of the interior cavity 34 from each other. As seen in FIG. 5-6, the tabs 39 of each pair may be located approximately 180° around the inner surface of the body 31 from each other, but may be differently positioned in other embodiments. The tabs 39 that are on the same side of the body 31 (e.g. the left or right-hand tabs 39 of each pair) can be axially aligned with each other, or in other words, aligned along the axial direction A, as shown in FIG. 12. In other embodiments, the tabs 39 may be differently configured, shaped, and/or positioned, and the handguard 30 may have a greater or smaller number of tabs 39. In a further embodiment, the tabs 39 may include additional retaining structure, such as clasps, hooks, lips, etc., and some or all of such structure may be flexible and/or resilient. The retaining structure may include additional and/or different types of retaining structure in other embodiments. For example, the retaining structure may include flanges, ridges, moveable fasteners or connectors, or other connecting structure, as well as bracing structures that create additional points of contact to stabilize the connection between the handguard 30 and the firearm 10.

The handguard 30 illustrated in FIGS. 3-12 can be connected to the forearm 20 of the firearm 10 by inserting the forearm 20 through the gap 36 between the edges 35. FIG. 3 shows the handguard 30 connected to the firearm 10 as shown in FIG. 1, although the handguard 30 may also be connected to the firearm 10 as shown in FIG. 2, or may be connected to a firearm with another configuration. It is understood that the body 31 of the handguard 30 may have some degree of flexibility or resiliency, such that the body 31 can be bent to expand the gap 36 to receive the forearm 20 within the interior cavity 34. Alternately, the forearm 20 may be inserted through the rear end opening 47. When the forearm 20 is received within the interior cavity 34, the tabs 39 are received in the slots 25 in the forearm 20 to connect the handguard 30 to the forearm 20. In one embodiment, the slots 25 are dimensioned and contoured in a complementary manner with the tabs 39, to resist movement of the handguard 30 in any direction once connected. The tabs 39 may flex or deform slightly during insertion into the slots 25. One or more screws or other fasteners may additionally be used to secure the connection between the handguard 30 and the forearm 20. For example, in one embodiment, a set screw or other screw (not shown) may be inserted through the bottom surface of the handguard 30 to abut or connect to the forearm 20. The handguard 30 may be removed from the forearm 20 as desired by removing the tabs 39 from the slots 25, which may involve bending or flexing the body 31 and/or the tabs 39 to provide clearance. Removal may also require loosening and/or removal of any screw(s) or additional fastener(s) as described above. In another embodiment, the forearm 20 may include a different structure for connection to the handguard 30, and such structures may be complementary with the retaining structure on the handguard 30. In a further embodiment, the handguard 30 may be configured for connection to a different part of the firearm 10, such as in an embodiment where the firearm 10 does not have a forearm 20.

In one embodiment, the handguard 30 may have a mounting structure that may include one or more rails 40 thereon for mounting of accessories. The handguard 30 shown in FIGS. 3-12 has three rails 40 connected to the outer surface 32, proximate the front end 38, extending rearwardly in the axial direction A. One of the rails 40 is connected to the bottom side of the body 31, opposite the gap 36, and the other two rails 40 are connected at the left and right sides. The left and right rails 40 are positioned about 180° around the outer surface 32 from each other and about 90° around the outer surface 32 from the bottom/middle rail 40. In another embodiment, the handguard 30 may have a different number of rails 40, for example, a single rail 40 or two rails positioned at 90° or 180° to each other, or more than three rails 40. Additionally, the rails 40 in any embodiment may be positioned at different angles to each other than the rails 40 shown in FIGS. 3-12. The rails 40 in this embodiment are Picatinny rails, although different types of rails or other mounting structures providing mounting functionality may be used, as similarly described above.

In the embodiment of FIGS. 3-12, the rails 40 extend rearwardly from the front end 38 in the axial direction, and extend a portion of the length of the body 31. As shown in FIGS. 7-8, the rails 40 extend less than 25% of the axial length of the body 31. In another embodiment, the rails 40 may extend over a different length, such as up to 50% of the length of the body 31. The rails 40 may also be different lengths. For example, in one embodiment, the bottom rail 40 may extend further rearward than the other rails 40, to permit mounting of a grip on the bottom rail 40 in a position closer to the receiver assembly 11. In further embodiments, the rails 40 may extend forwardly from the rear end 37 of the body 31, or may be positioned completely between the ends 37, 38 and may not extend to either of the ends 37, 38. The rails 40 may extend the entire length of the body 31, or substantially the entire length, such as in the embodiment illustrated in FIGS. 31-39. As described above, a flashlight 41 is shown mounted on the bottom rail 40 of the handguard 30. Examples of other accessories that may be mounted on the rails 40 of the handguard 30 and/or the rails 14 of the firearm 10 may include, without limitation: sights, including fixed sights, adjustable sights, laser sights and reflex sights; scopes, night vision, or other optical equipment; grips or handles; auxiliary weapons; bipods, tripods, or other support devices. It is understood that multiple accessories may be mounted on the rails 14, 40, including mounting multiple accessories on the same rail 14, 40, for example, mounting a grip and a flashlight on the bottom rail 40 of the handguard 30.

The handguard 30 may also have a gripping portion or section 42 to provide a gripping surface for the user. In the embodiment in FIGS. 3-12, the body 31 of the handguard 30 has a gripping section 42 that extends along and occupies a portion of the axial length of the body 31 and a mounting portion or section 43 that extends along and occupies another portion of the axial length of the body 31. The mounting section 43 includes the rails 40 and is generally defined by the lengths of the rails 40, or the length of the longest rail 40, if the rails 40 are different lengths. In the handguard of FIGS. 3-12, the gripping section 42 has a smoothly curved and rounded outer surface 32 to facilitate gripping, as well as a plurality of parallel, circumferential gripping ridges 44 to enhance gripping. The gripping section 42 may additionally or alternately include other structures and features, including different surface contours and shapes. For example, the gripping section 42 may include an integral grip, such as a contoured grip, a pistol grip, or other such structures providing gripping functionality. The handguard 30 also includes cut-outs or cut-out portions 45 proximate the front end 38, created by indents in the edges 35 of the body 31. These cut-outs 45 increase the size of the gap 36 and expose the grouped vent holes 21 at the front end 22 of the forearm 20, as shown in FIG. 3. In the embodiment illustrated in FIGS. 3-12, the boundaries of the cut-outs 45 are generally aligned with the juncture between the gripping section 42 and the mounting section 43, such that the cut-outs 45 are positioned entirely within the mounting section 43, although this configuration may be different in other embodiments. The sizes and shapes of the cut-outs 45 may be different in other embodiments, and in some embodiments, the handguard 30 may have no cut-outs 45 or a different number of cut-outs 45.

As described above, the body 31 of the handguard 30 may have a semi-tubular shape, and may have a C-shaped cross-section when viewed perpendicular to the axial direction A. The body 31 may also have different cross-sectional shapes at different portions along the axial length, including differently-shaped C-shaped cross-sections. For example, in the handguard 30 shown in FIGS. 3-12, the body 31 has one C-shaped cross-sectional shape in the gripping section 42 and a slightly different C-shaped cross-sectional shape in the mounting section 43. The mounting section 43 has the rails 40 and a slightly larger gap 36 due to the cut-outs 45, creating a different cross-sectional shape as compared to the gripping section 42.

FIGS. 13-21 illustrate another embodiment of a handguard 130 that contains many components in common with the handguard 30 of FIGS. 3-12, and such common components are referred to herein using the same reference numbers. Certain of such common features may not be described again with respect to the handguard 130 of FIGS. 13-21 for the sake of brevity. As illustrated in FIGS. 13-21, the handguard 130 has a body 31 in the form of a semi-tubular shell with a convex outer surface 32 and a concave inner surface 33, where the body 31 and the interior cavity 34 of the handguard 130 are elongated along an axis of elongation that runs in the axial direction A, as described above. As seen in FIGS. 14-18, in this embodiment, the convex outer surface 32 and the concave inner surface 33 are smoothly curved surfaces over the entire body 31.

The body 31 of the handguard 130 shown in FIGS. 13-21 is generally C-shaped and/or semi-tubular in shape as described above, such that the outer surface 32 and the inner surface 33 both extend between the edges 35, and extend around an angular range of at least 180° but less than 360°, to thereby create the gap 36. In the embodiment of FIGS. 13-21, the entire outer surface 32 of the handguard 130 is smoothly curved and rounded over the entire axial length to facilitate gripping, and includes a plurality of parallel, circumferential gripping ridges 44 to enhance gripping. The handguard 130 has no rails 40 and no cut-outs 45. However, the handguard 130 may contain rails 40, cut-outs 45, or other features in other embodiments. Thus, the body 31 of the handguard 130 has a generally constant C-shaped cross-sectional shape over the entire axial length, with the gripping ridges 44 providing only slight variation.

Figure 16:
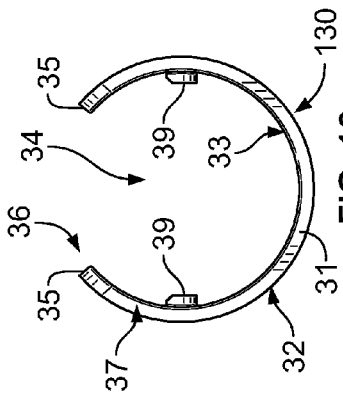
FIG. 16 is a rear view of the handguard of FIG. 14.
Figure 15:
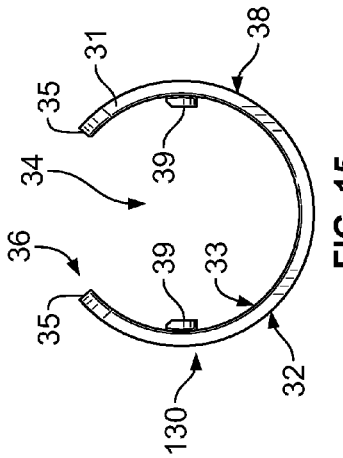
FIG. 15 is a front view of the handguard of FIG. 14.
Figure 17:
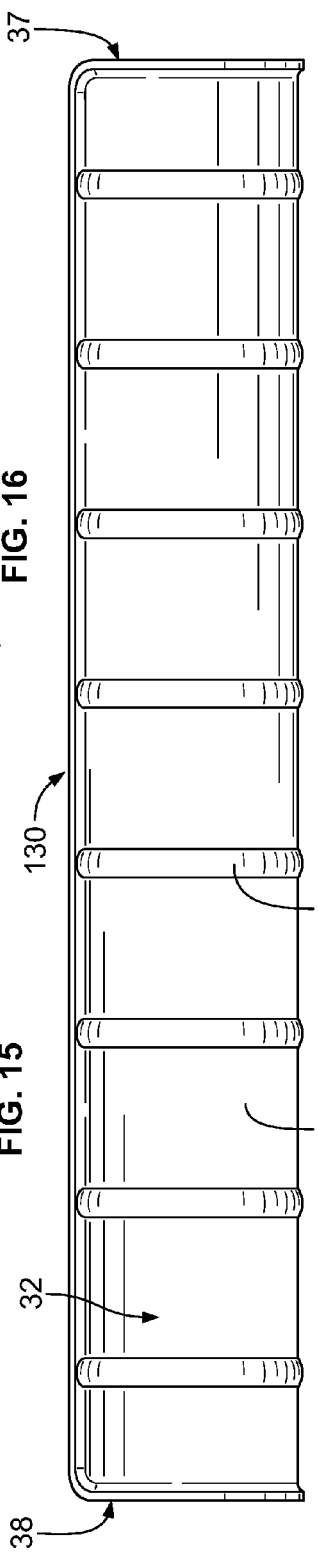
FIG. 17 is a right side view of the handguard of FIG. 14.
Figure 18:
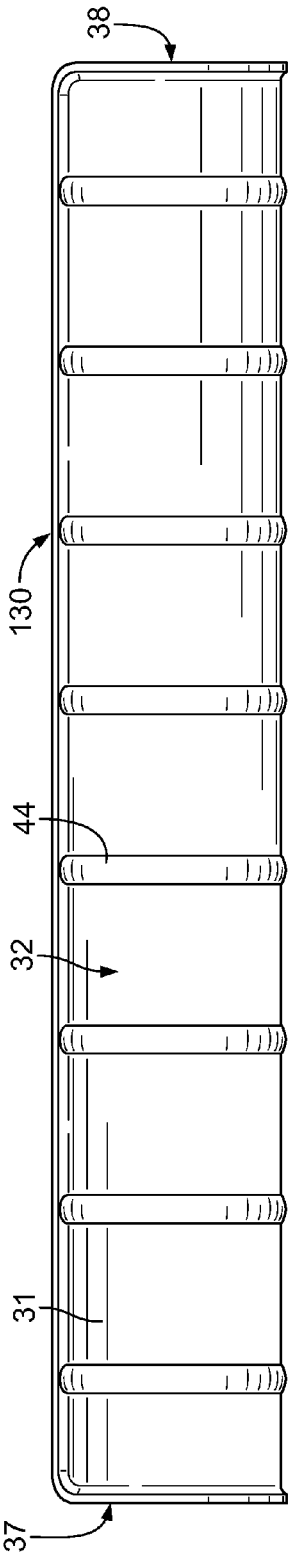
FIG. 18 is a left side view of the handguard of FIG. 14.
Figure 19:
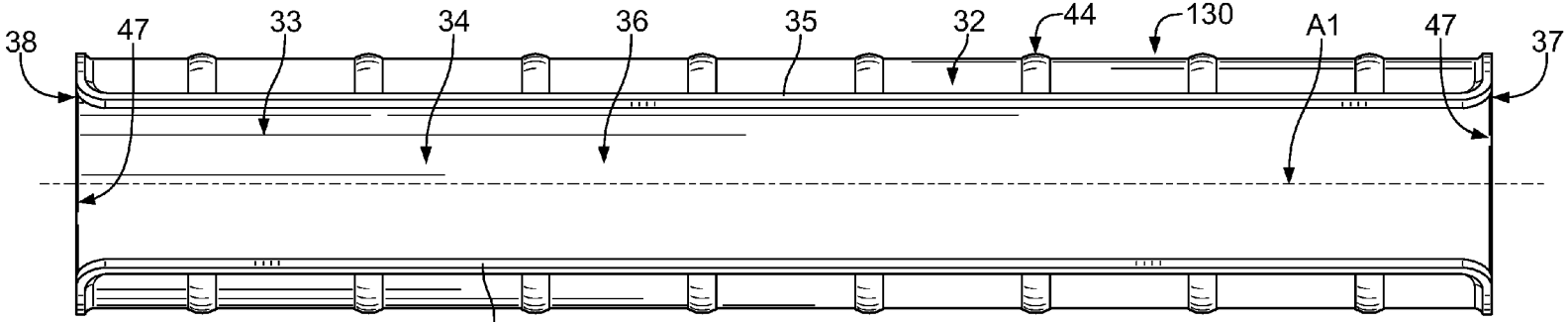
FIG. 19 is a top view of the handguard of FIG. 14.
Figure 20:
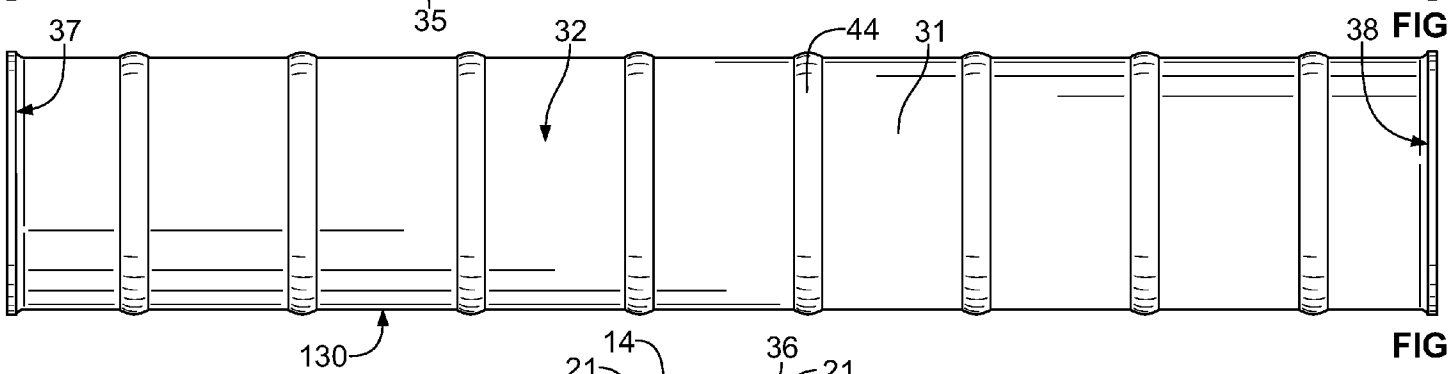
FIG. 20 is a bottom view of the handguard of FIG. 14.
Figure 21:
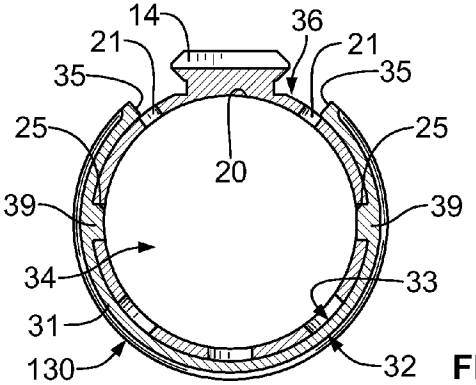
FIG. 21 is a cross-section view of the handguard of FIG. 14, taken normal to the axial direction, shown connected to the forearm of the rifle of FIG. 13.

The handguard 130 has retaining structure in the form of retaining tabs 39 located on the inner surface 33 of the body 31, similarly to the handguard 30 of FIGS. 3-12. As similarly described above, in this embodiment, the handguard 130 contains two pairs of retaining tabs 39, with each pair positioned on opposite sides of the interior cavity 34 from each other. Not all of the retaining tabs 39 are illustrated in FIGS. 13-21, and it is understood that the retaining tabs 39 are shaped and positioned the same as illustrated in FIGS. 5-6 and 11-12 with respect to the embodiment of FIGS. 3-12. As seen in FIGS. 15-16 and described above, the tabs 39 of each pair may be approximately 180° around the inner surface of the body 31 from each other, but may be differently positioned in other embodiments. Additionally, the tabs 39 that are on the same side of the body 31 (e.g. the left or right-hand tabs 39 of each pair) can be axially aligned with each other, as described above and shown in FIG. 12.

Figure 13:
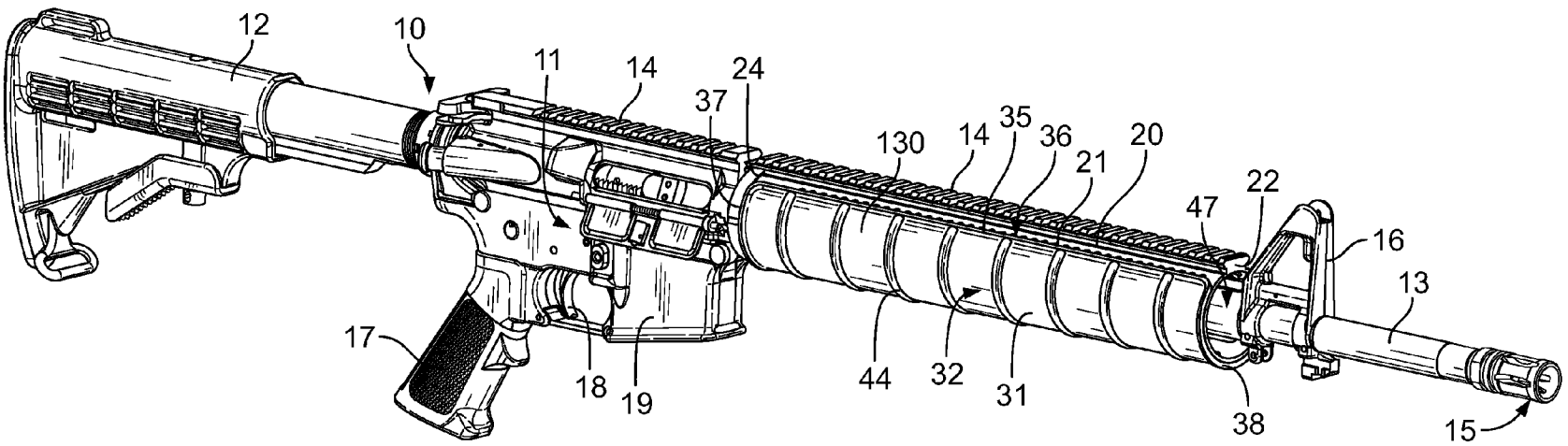
FIG. 13 is a perspective view of the rifle of FIG. 2 with another embodiment of a handguard according to aspects of the present invention connected to a forearm of the rifle.
Figure 14:
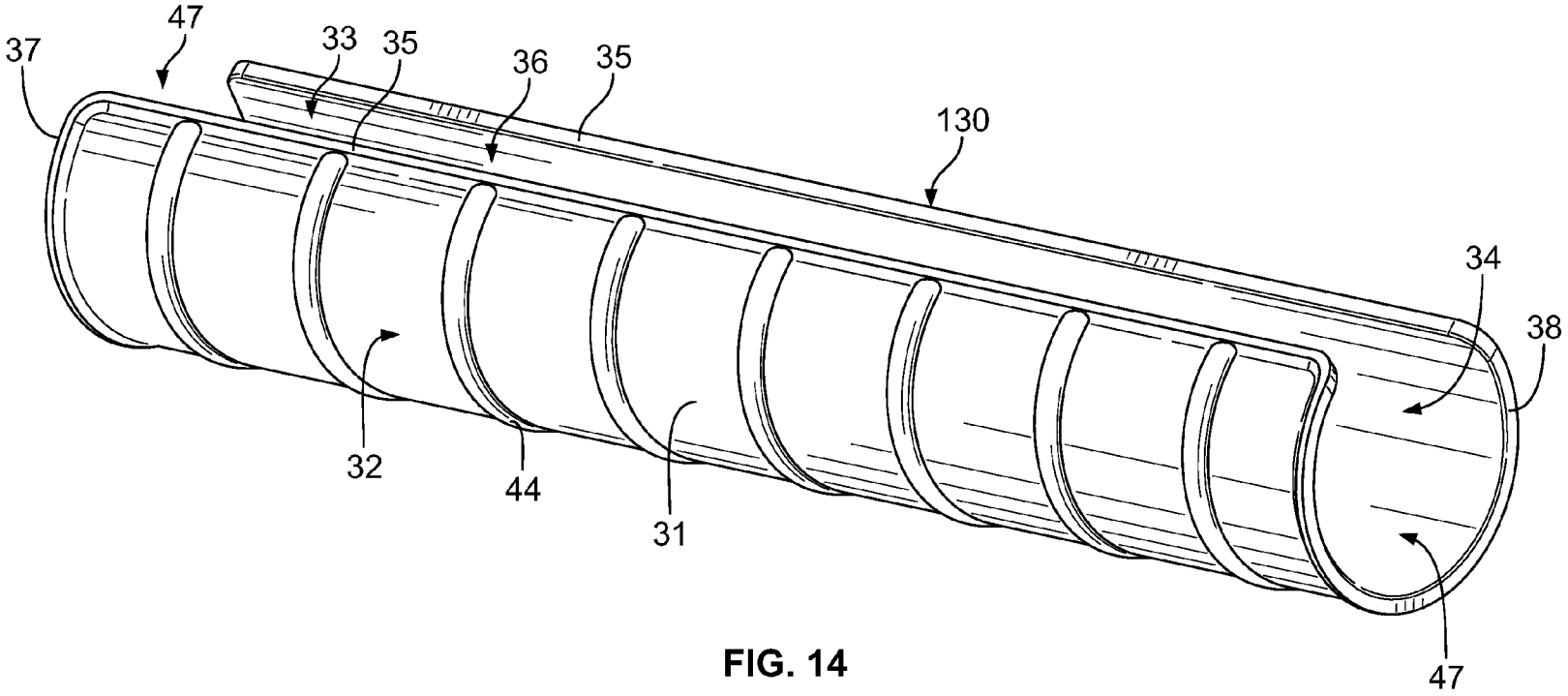
FIG. 14 is a perspective view of the handguard of FIG. 13.

The handguard 130 illustrated in FIGS. 13-21 can be connected to the forearm 20 of the firearm 10 in the same manner(s) described above with respect to the handguard 30 of FIGS. 3-12. FIG. 13 shows the handguard 130 connected to the firearm 10 as shown in FIG. 2, although the handguard 130 may also be connected to the firearm 10 as shown in FIG. 1, or may be connected to a firearm with another configuration. As described above, the handguard 130 may also be configured to be removable from the firearm 10, in the same manner(s) described above.

FIGS. 22-30 illustrate another embodiment of a handguard 230 that contains many components in common with the handguards 30, 130 of FIGS. 3-21, and such common components are referred to herein using the same reference numbers. Certain of such common features may not be described again with respect to the handguard 230 of FIGS. 22-30 for the sake of brevity. As illustrated in FIGS. 22-30, the handguard 230 has a body 31 in the form of a semi-tubular shell with a convex outer surface 32 and a concave inner surface 33, where the body 31 and the interior cavity 34 of the handguard 230 are elongated along an axis of elongation that runs in the axial direction A, as described above. As seen in FIGS. 23-27, in this embodiment, the convex outer surface 32 and the concave inner surface 33 are smoothly curved surfaces over the entire body 31.

Figure 25:
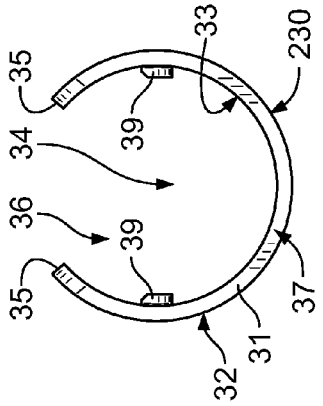
FIG. 25 is a rear view of the handguard of FIG. 23.
Figure 26:
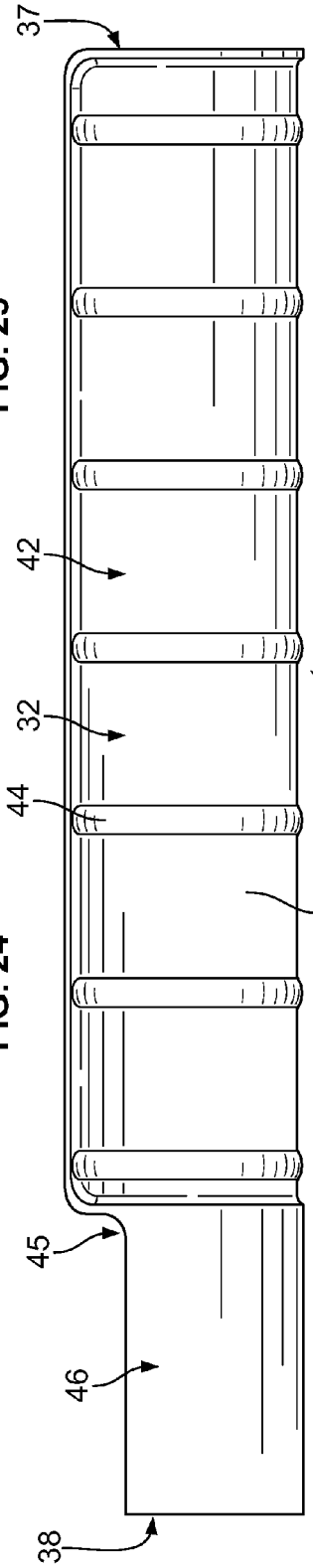
FIG. 26 is a right side view of the handguard of FIG. 23.
Figure 27:
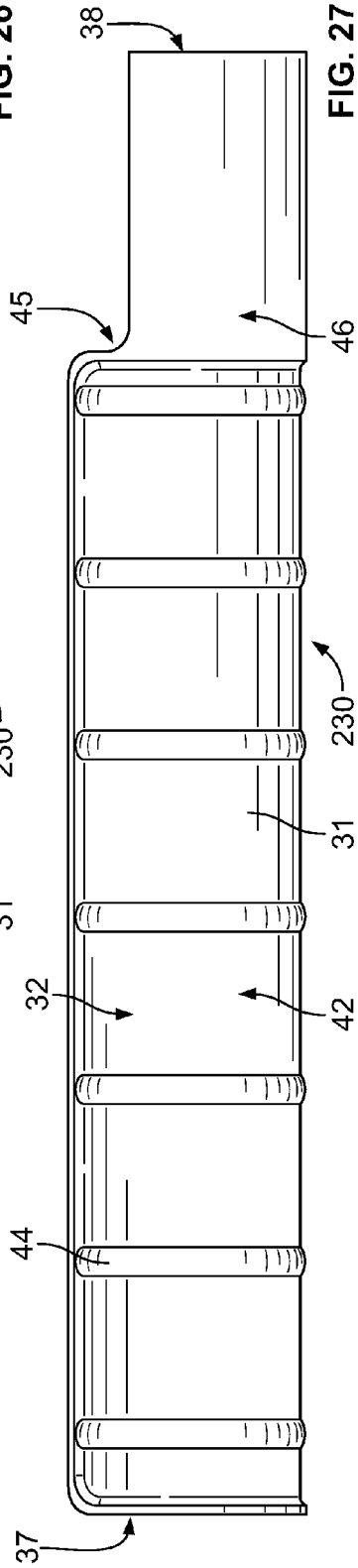
FIG. 27 is a left side view of the handguard of FIG. 23.
Figure 28:
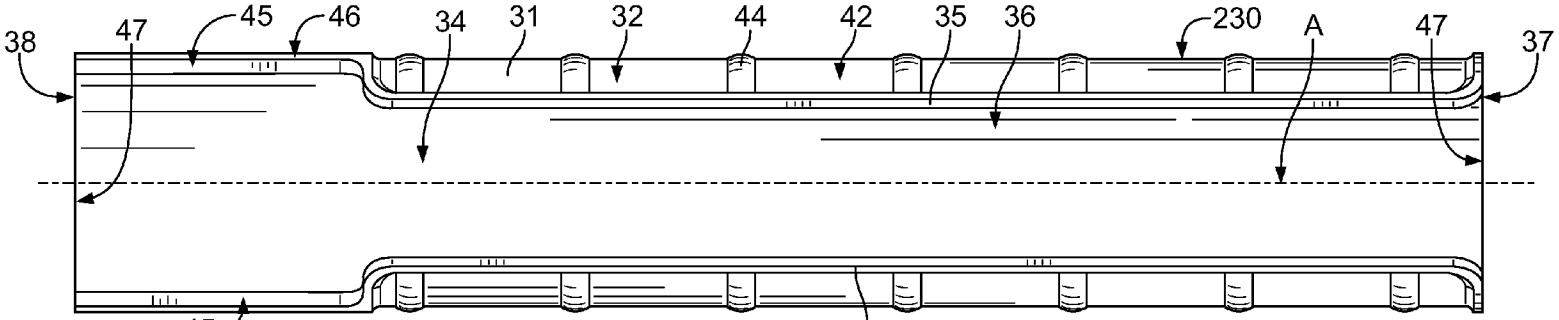
FIG. 28 is a top view of the handguard of FIG. 23.
Figure 29:
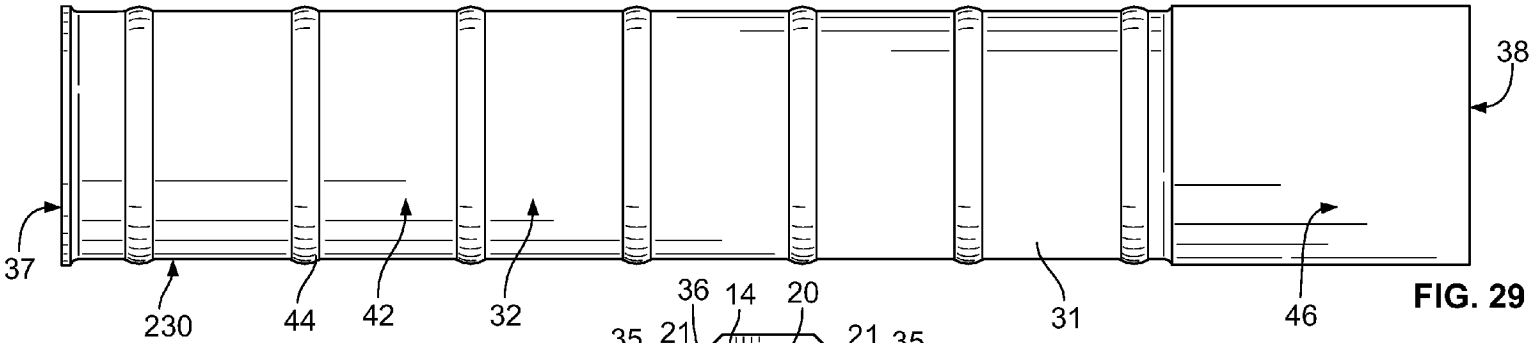
FIG. 29 is a bottom view of the handguard of FIG. 23.
Figure 30:
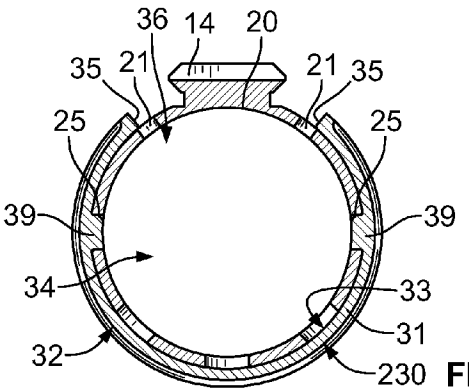
FIG. 30 is a cross-section view of the handguard of FIG. 23, taken normal to the axial direction, shown connected to the forearm of the rifle of FIG. 22.

The body 31 of the handguard 230 shown in FIGS. 22-30 is generally C-shaped and/or semi-tubular in shape as described above, such that the outer surface 32 and the inner surface 33 both extend between the edges 35, and extend around an angular range of at least 180° but less than 360°, to thereby create the gap 36. In the embodiment of FIGS. 22-30, the entire outer surface 32 of the handguard 230 is smoothly curved and rounded over the entire axial length, to facilitate gripping, and the majority portion of the body 31 includes a plurality of parallel, circumferential gripping ridges 44 to enhance gripping. The portion of the body 31 with the gripping ridges 44 may be considered to be a gripping section 42 as described above. The handguard 230 shown in FIGS. 22-30 have a smooth portion or section 46 of the body 31 that contains no gripping ridges 44 and includes cut-outs 45 similar to the handguard 30 of FIGS. 3-12. Thus, the handguard 230 in this embodiment has two different C-shaped cross-sectional shapes. The body 31 has one C-shaped cross-sectional shape in the gripping section 42 and a slightly different C-shaped cross-sectional shape in the smooth section 46. The smooth section 46 has a slightly larger gap 36 between the edges 35, due to the cut-outs 45, creating a different cross-sectional shape as compared to the gripping section 42. As shown in FIGS. 26-27, the smooth section 46 may extend less than 25% of the axial length of the body 31, and may extend over a different length in other embodiments, such as up to 50% of the length of the body 31. The handguard 230 has no rails 40 in this embodiment, however, the handguard 230 may contain rails 40 or other features in other embodiments.

Figure 24:
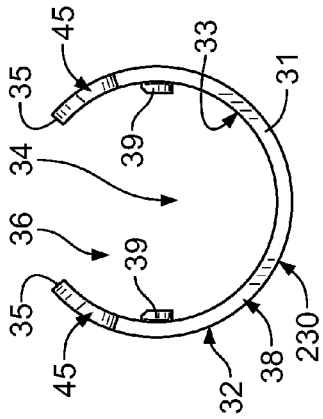
FIG. 24 is a front view of the handguard of FIG. 23.

The handguard 230 has retaining structure in the form of retaining tabs 39 located on the inner surface 33 of the body 31, similarly to the handguard 30 of FIGS. 3-12. As similarly described above, in this embodiment, the handguard 230 contains two pairs of retaining tabs 39, with each pair positioned on opposite sides of the interior cavity 34 from each other. Not all of the retaining tabs 39 are illustrated in FIGS. 22-30, and it is understood that the retaining tabs 39 are shaped and positioned the same as illustrated in FIGS. 5-6 and 11-12 with respect to the embodiment of FIGS. 3-12. As seen in FIGS. 24-25 and described above, the tabs 39 of each pair may be approximately 180° around the inner surface of the body 31 from each other, but may be differently positioned in other embodiments. Additionally, the tabs 39 that are on the same side of the body 31 (e.g. the left or right-hand tabs 39 of each pair) can be axially aligned with each other, as described above and shown in FIG. 12.

Figure 22:
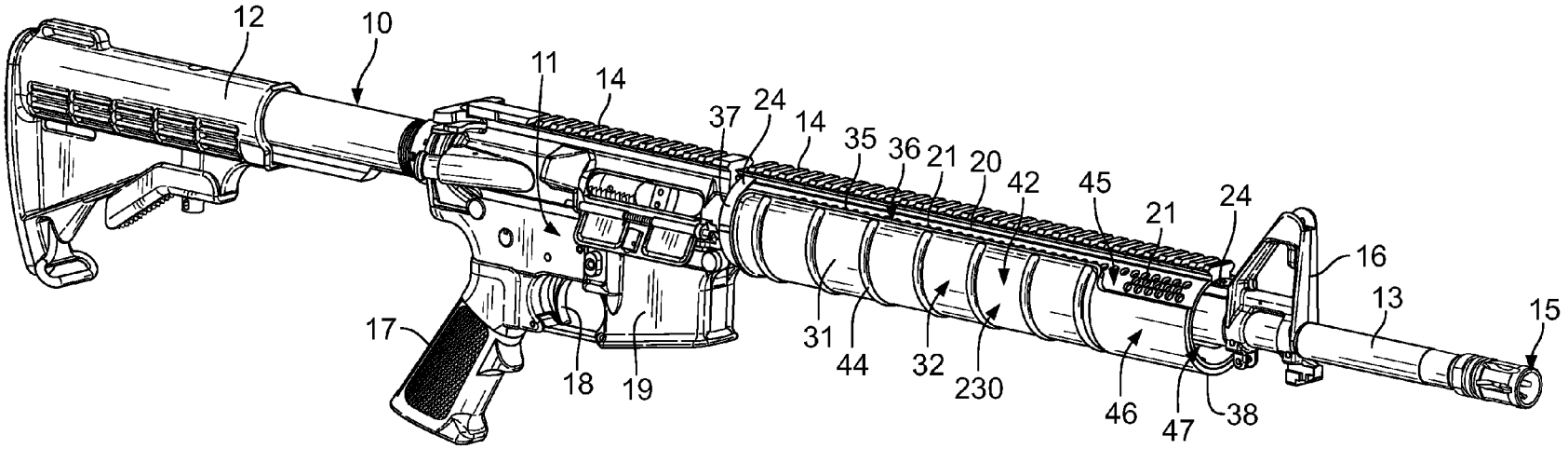
FIG. 22 is a perspective view of the rifle of FIG. 2 with another embodiment of a handguard according to aspects of the present invention connected to a forearm of the rifle.
Figure 23:
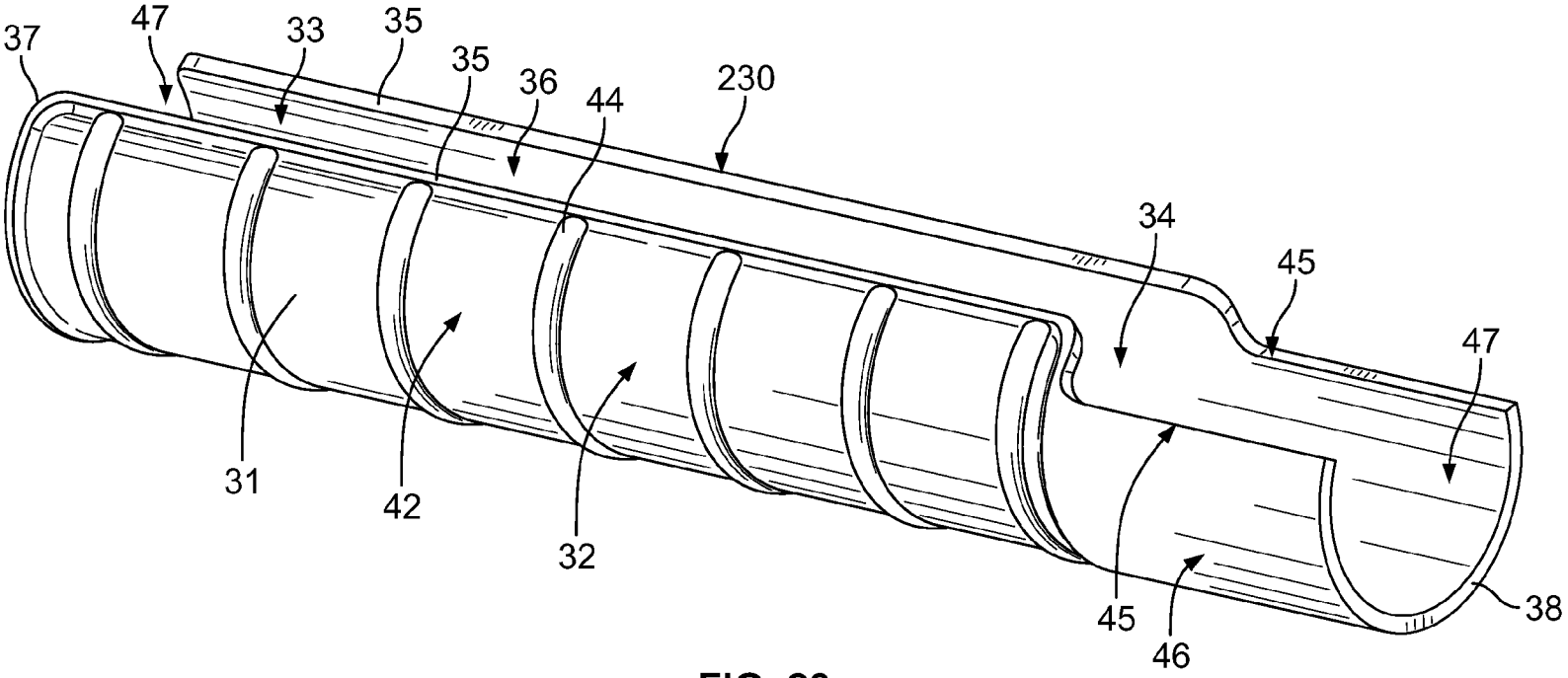
FIG. 23 is a perspective view of the handguard of FIG. 22.

The handguard 230 illustrated in FIGS. 22-30 can be connected to the forearm 20 of the firearm 10 in the same manner(s) described above with respect to the handguard 30 of FIGS. 3-12. FIG. 22 shows the handguard 230 connected to the firearm 10 as shown in FIG. 2, although the handguard 230 may also be connected to the firearm 10 as shown in FIG. 1, or may be connected to a firearm with another configuration. As described above, the handguard 230 may also be configured to be removable from the firearm 10, in the same manner(s) described above.

FIGS. 31-39 illustrate another embodiment of a handguard 330 that contains many components in common with the handguards 30, 130, 230 of FIGS. 3-30, and such common components are referred to herein using the same reference numbers. Certain of such common features may not be described again with respect to the handguard 330 of FIGS. 31-39 for the sake of brevity. As illustrated in FIGS. 31-39, the handguard 330 has a body 31 in the form of a semi-tubular shell with a convex outer surface 32 and a concave inner surface 33, where the body 31 and the interior cavity 34 of the handguard 330 are elongated along an axis of elongation that runs in the axial direction A, as described above. In the embodiment of FIGS. 31-39, the concave inner surface 33 is smoothly curved over a majority or the entirety of the axial length of the body 31. The handguard 330 of FIGS. 31-39 has an elongated recess 48 that extends in the axial direction A over at least a portion of the axial length of the body 31. The outer surface 32 is smoothly curved and rounded between the ridges 40.

The body 31 of the handguard 330 shown in FIGS. 31-39 is generally C-shaped and/or semi-tubular in shape as described above, such that the outer surface 32 and the inner surface 33 both extend between the edges 35, and extend around an angular range of at least 180° but less than 360°, to thereby create the gap 36. The handguard 330 has mounting structure in the form of rails 40 as described above with respect to the handguard 30 of FIGS. 3-12. In the embodiment of FIGS. 31-39, the rails 40 extend the entire axial length of the body 31, from the front end 38 to the rear end 37. As similarly described above, in other embodiments, the rails 40 may be different in length, position or relative position, type, configuration, etc., and in one example, may not extend completely to the front end 38 and/or the rear end 37. The handguard 330 has no cut-outs 45 in this embodiment, but may contain cut-outs 45 or other features in other embodiments. Thus, the body 31 of the handguard 330 has a generally constant C-shaped cross-sectional shape over the entire axial length, with the variation in the structure of the rails 40 creating only slight variation.

Figures 33, 34, 35, 36:
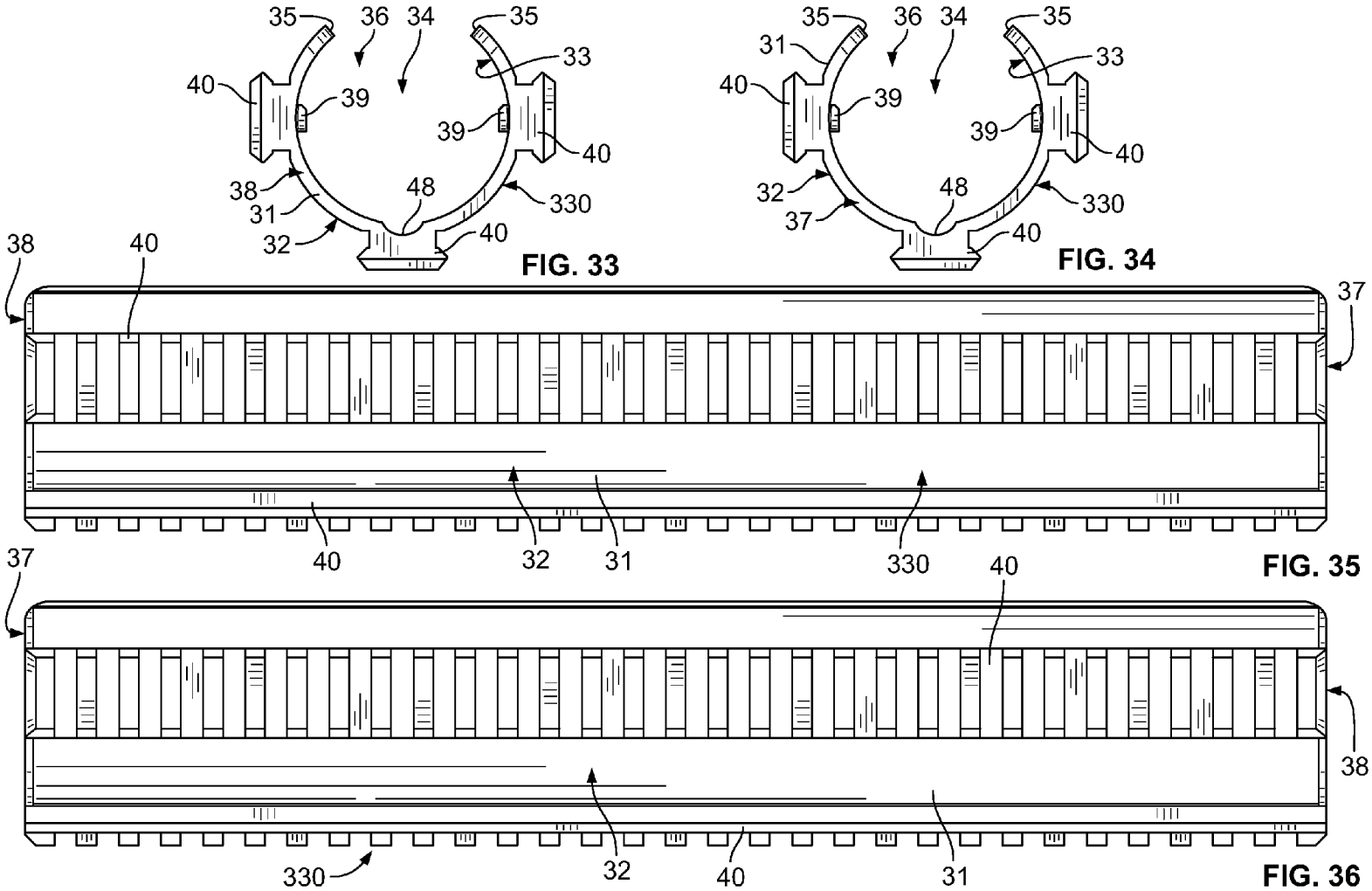
FIG. 33 is a front view of the handguard of FIG. 32.
FIG. 34 is a rear view of the handguard of FIG. 32.
FIG. 35 is a right side view of the handguard of FIG. 32.
FIG. 36 is a left side view of the handguard of FIG. 32.
Figure 37:
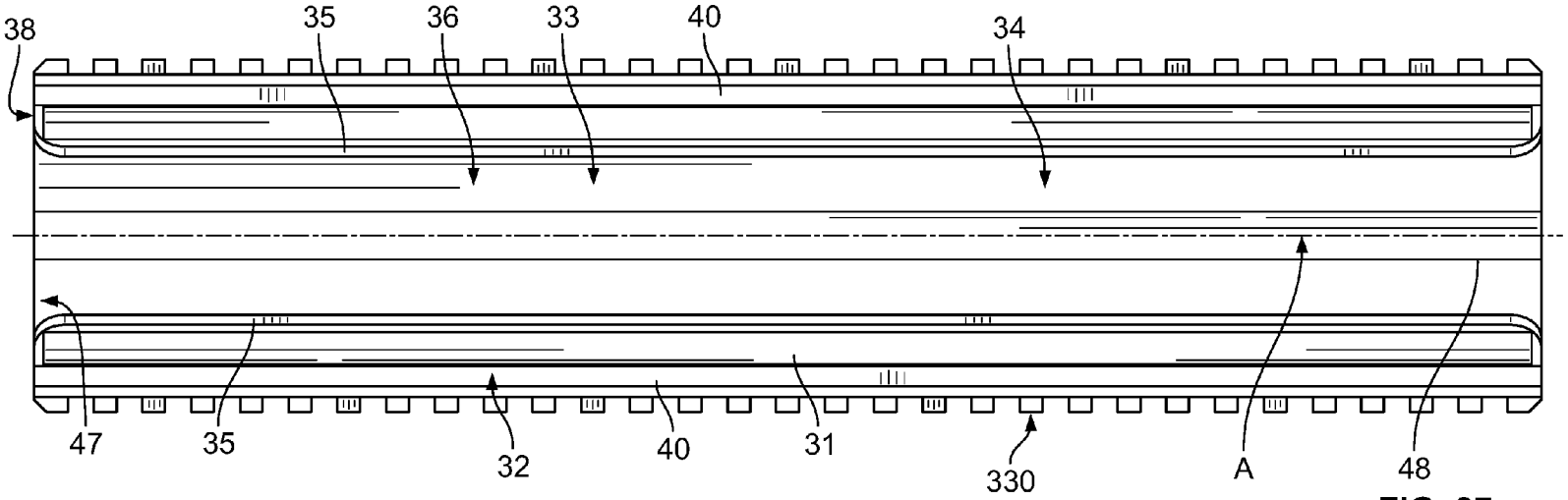
FIG. 37 is a top view of the handguard of FIG. 32.
Figure 38:
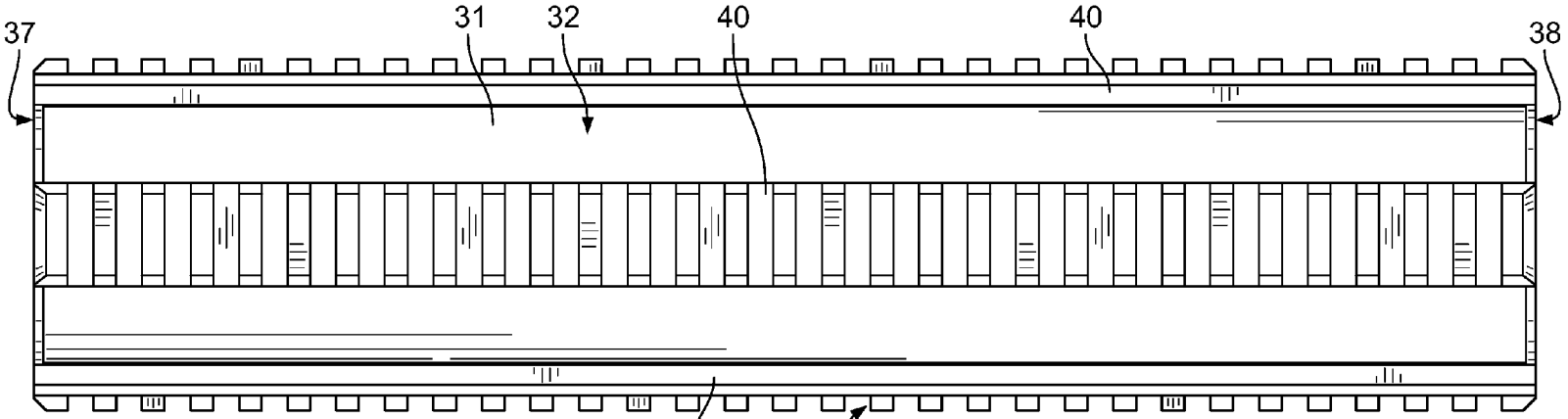
FIG. 38 is a bottom view of the handguard of FIG. 32.
Figure 39:
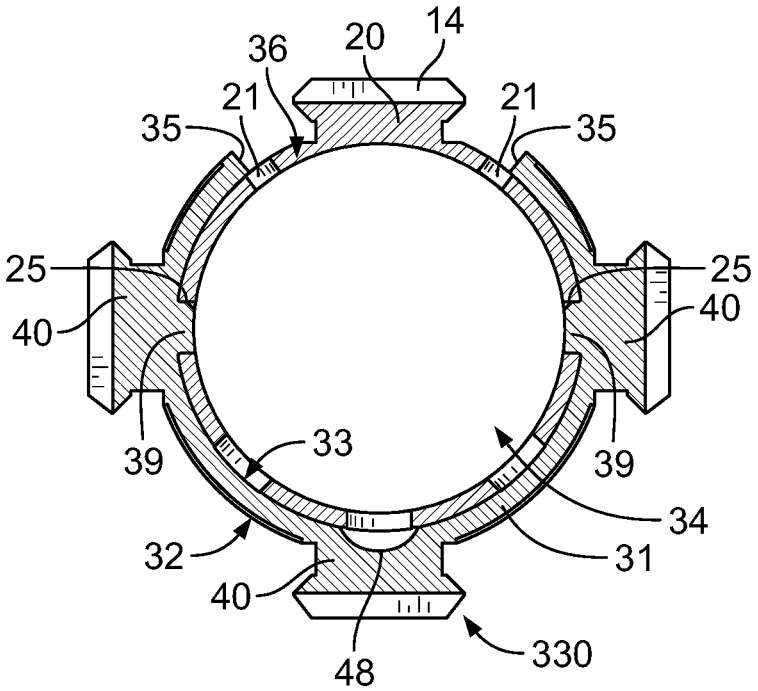
FIG. 39 is a cross-section view of the handguard of FIG. 32, taken normal to the axial direction, shown connected to the forearm of the rifle of FIG. 31.
Figure 40:
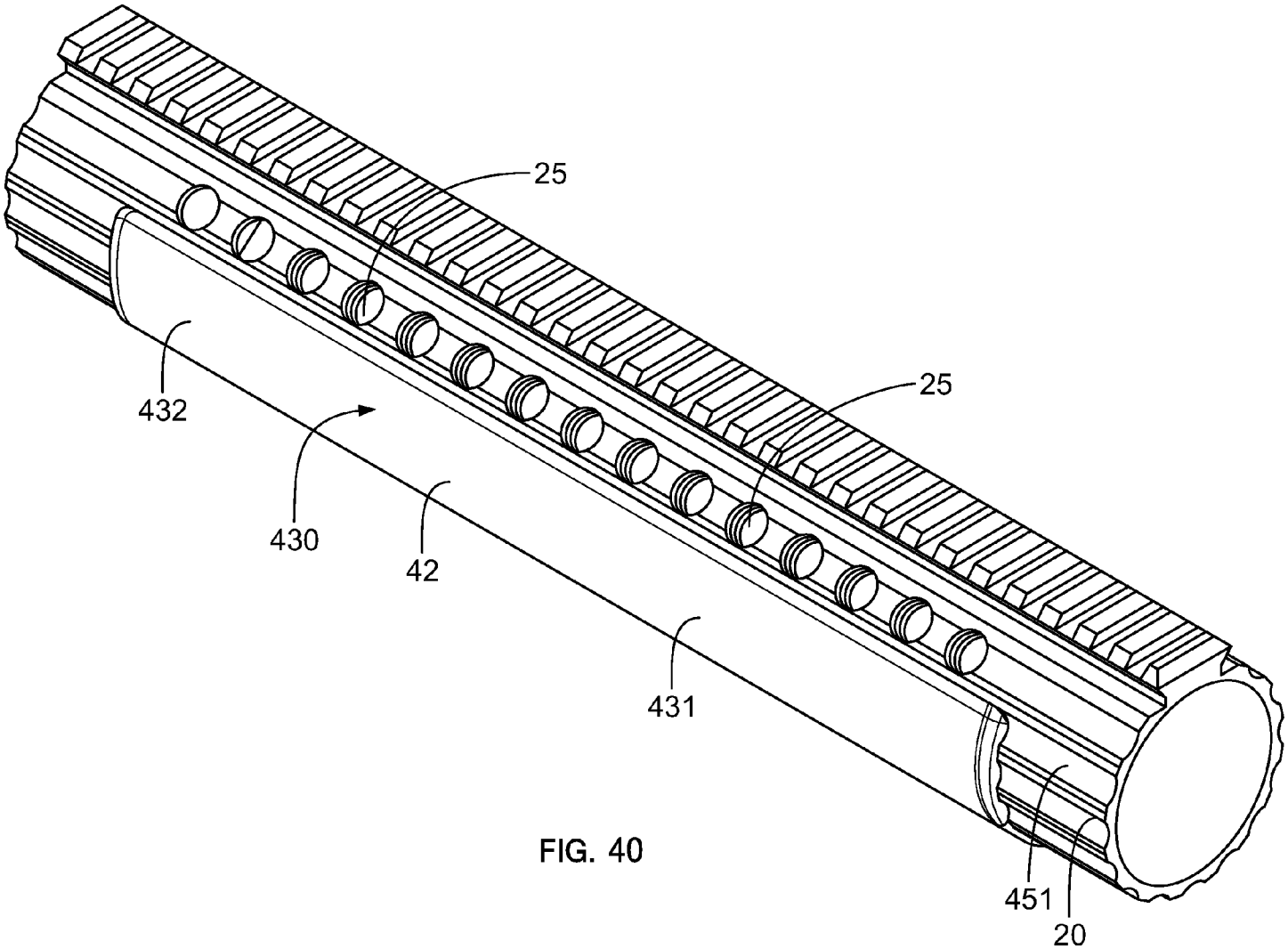
FIG. 40 is a perspective view of another exemplary handguard.

The handguard 330 has retaining structure in the form of retaining tabs 39 located on the inner surface 33 of the body 31, similarly to the handguard 30 of FIGS. 3-12. As similarly described above, in this embodiment, the handguard 330 contains two pairs of retaining tabs 39, with each pair positioned on opposite sides of the interior cavity 34 from each other. Not all of the retaining tabs 39 are illustrated in FIGS. 31-39, and it is understood that the retaining tabs 39 are shaped and positioned the same as illustrated in FIGS. 5-6 and 11-12 with respect to the embodiment of FIGS. 3-12. As seen in FIGS. 33-34 and described above, the tabs 39 of each pair may be approximately 180° around the inner surface of the body 31 from each other, but may be differently positioned in other embodiments. Additionally, the tabs 39 that are on the same side of the body 31 (e.g. the left or right-hand tabs 39 of each pair) can be axially aligned with each other, as described above and shown in FIG. 12.

Figure 31:
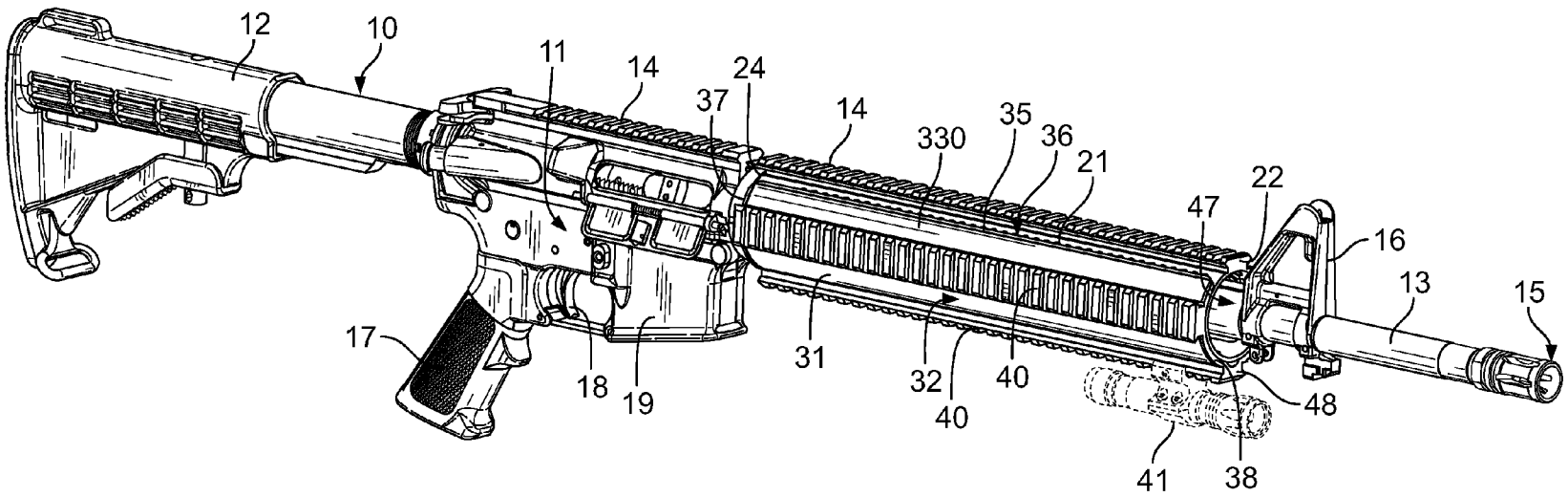
FIG. 31 is a perspective view of the rifle of FIG. 2 with another embodiment of a handguard according to aspects of the present invention connected to a forearm of the rifle.
Figure 32:
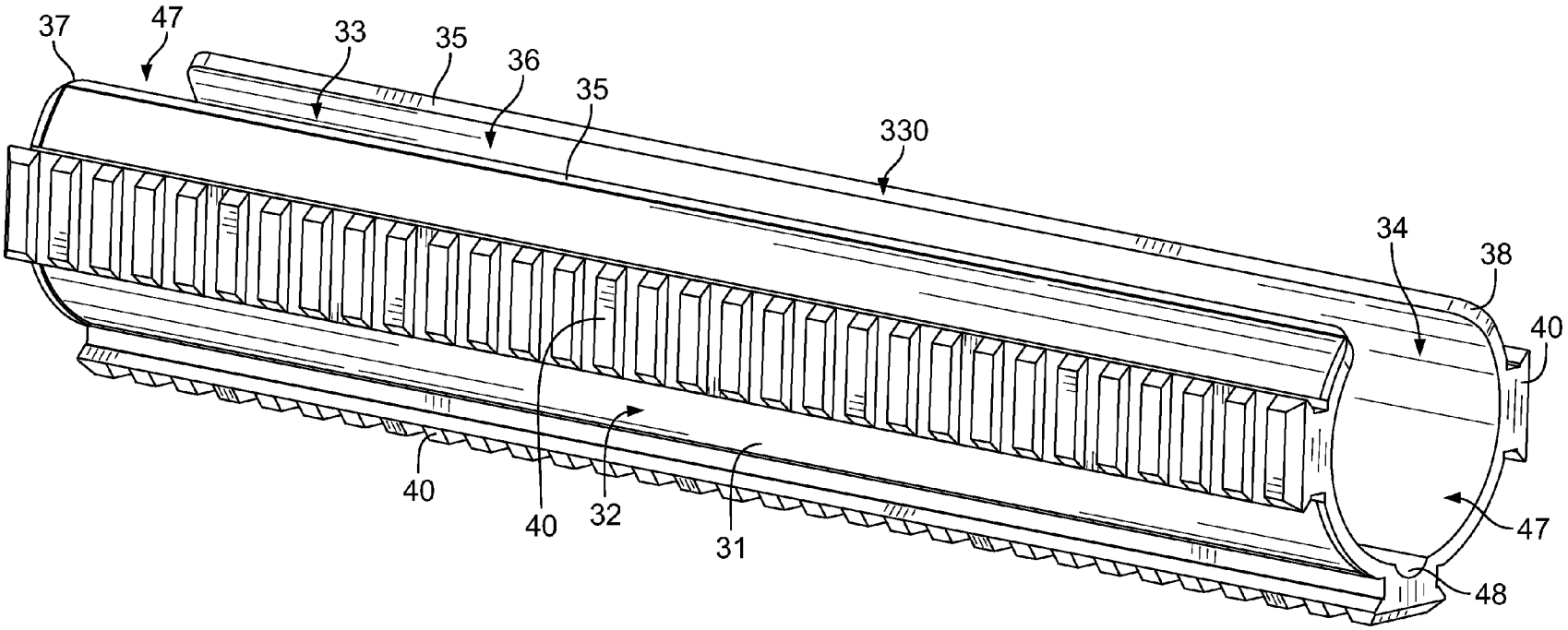
FIG. 32 is a perspective view of the handguard of FIG. 31.

The handguard 330 illustrated in FIGS. 31-39 can be connected to the forearm 20 of the firearm 10 in the same manner(s) described above with respect to the handguard 30 of FIGS. 3-12. FIG. 31 shows the handguard 330 connected to the firearm 10 as shown in FIG. 2, although the handguard 330 may also be connected to the firearm 10 as shown in FIG. 1, or may be connected to a firearm with another configuration. As described above, the handguard 330 may also be configured to be removable from the firearm 10, in the same manner(s) described above. The axial recess 48 may assist in bending or flexing the body 31 to aid with connection and removal.

Figure 42:
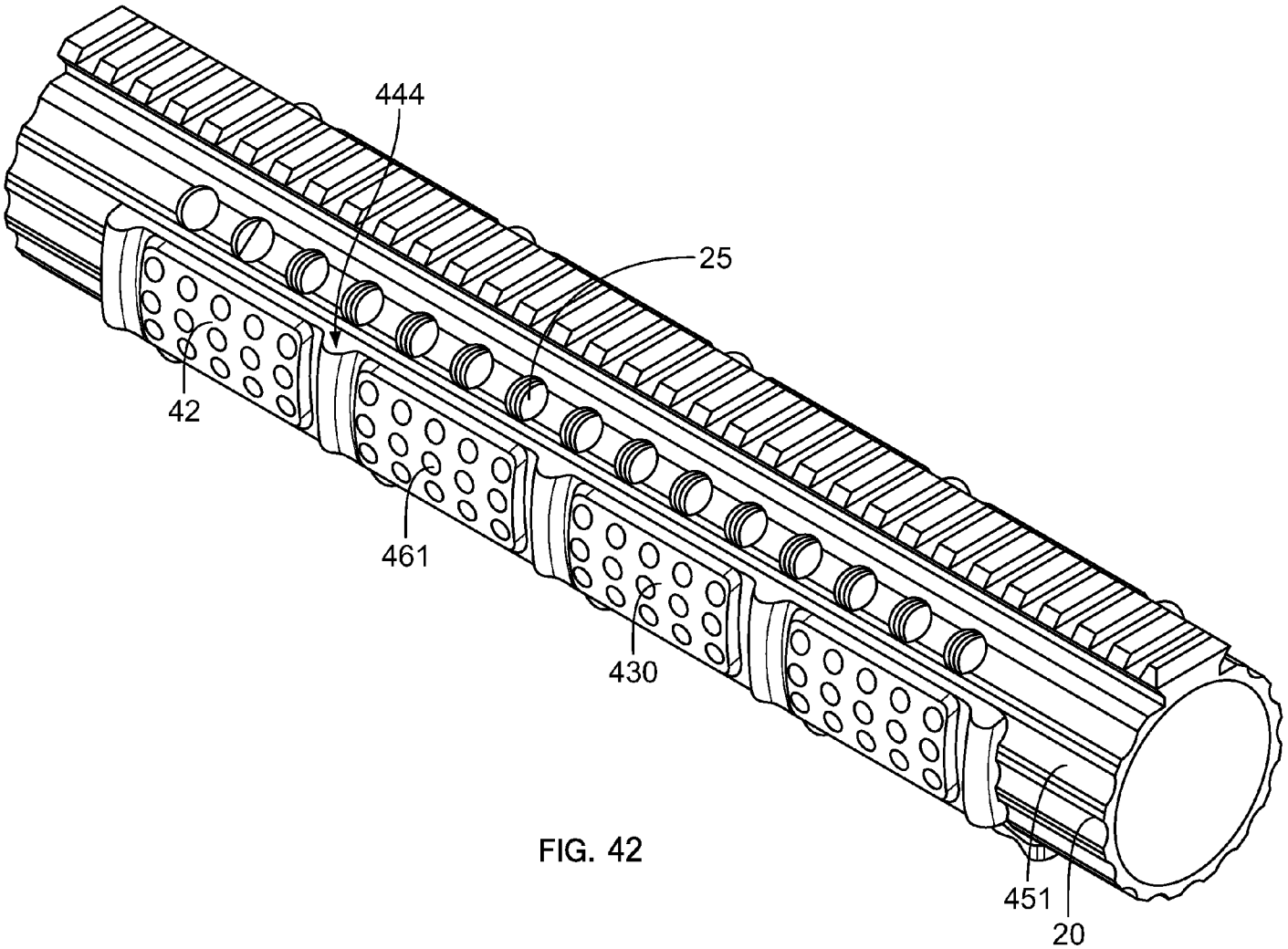
FIG. 42 is a perspective view of another exemplary handguard.
Figure 43:
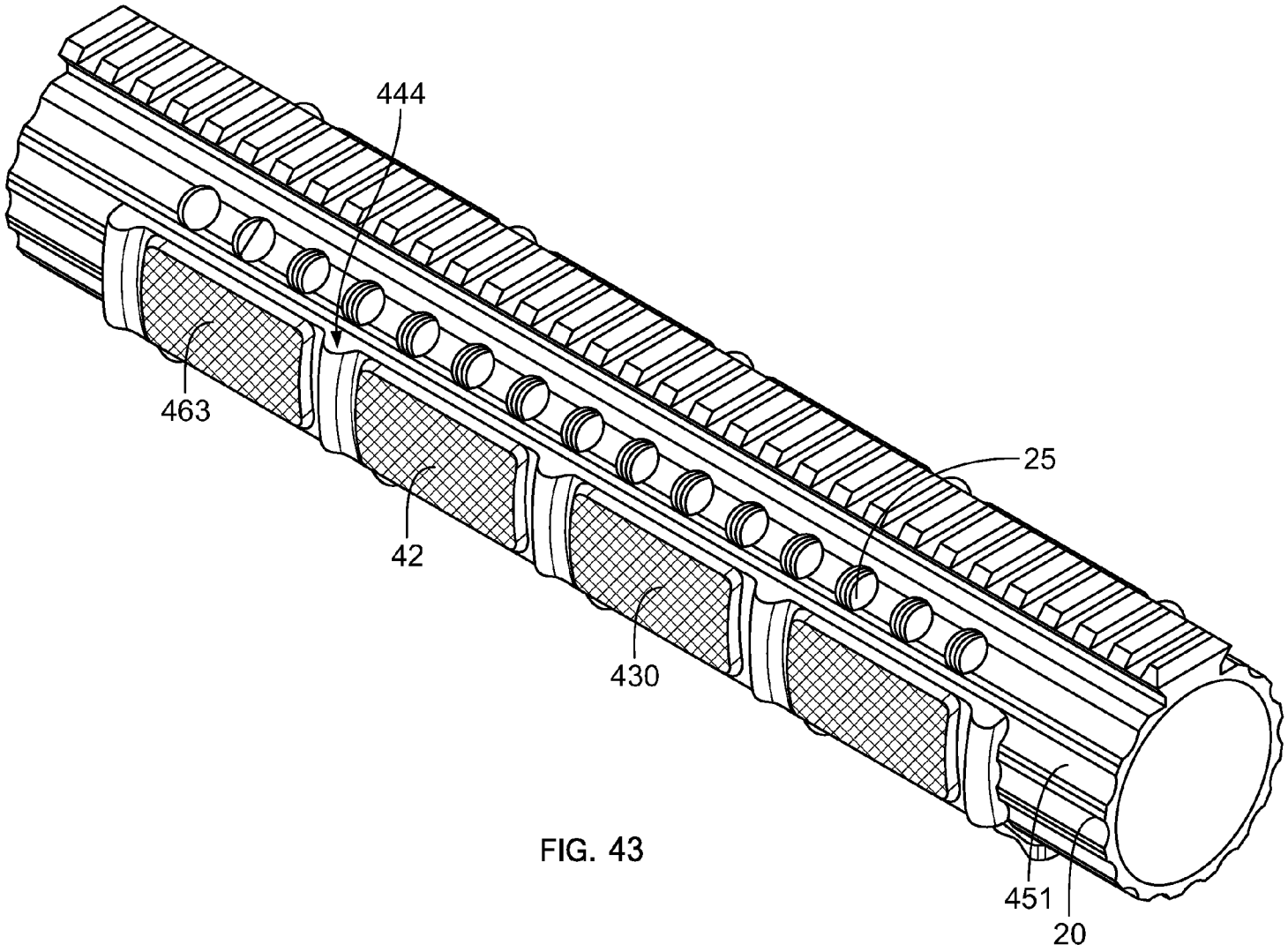
FIG. 43 is a perspective view of another exemplary handguard.
Figure 44:
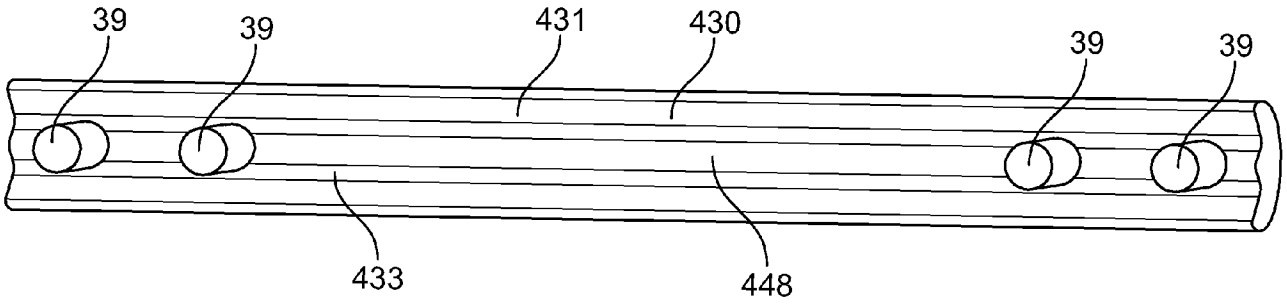
FIG. 44 is a bottom view of an exemplary handguard.

FIGS. 40-45 illustrate another embodiment of a handguard 430 that contains many components in common with the handguards 30, 130, 230, 330 of FIGS. 3-39, and such common components are referred to herein using the same reference numbers. Certain of such common features may not be described again with respect to the handguard 430 of FIGS. 40-45 for the sake of brevity. As illustrated in FIGS. 40-45, the handguard 430 has a body 431 in the form of a semi-tubular shell with a convex outer surface 432 and a concave inner surface 433, where the body 431 is elongated along an axis of elongation that runs in the axial direction A, as described above. In the embodiment of FIGS. 40-45, the concave inner surface 433 is smoothly curved over a majority or the entirety of the axial length of the body 431. As shown in FIG. 44, the handguard 430 has an elongated bump or ridge 448 that extends in the axial direction A over at least a portion of the axial length of the body 431. It is understood that the inner surface 433 and/or the outer surface 432, as described herein, may include a plurality of different surfaces, including different contours and surface features.

The handguard 430 is configured for connection to the forearm 20 of the firearm 10. The handguard 430 may have retaining structure to retain the handguard 430 to the firearm 10, and such retaining structure may be removable/releasable retaining structure to removably retain the handguard 430 to the firearm 10. In one embodiment, the handguard 430 has retaining structure in the form of retaining tabs 39 located on the inner surface 433 of the body 431. The retaining tabs 39 project inwardly from the inner surface 433, and may be at least somewhat flexible and/or resilient to aid connection to the firearm 10, as described above. In this embodiment, the handguard 430 contains pairs of retaining tabs 39, with each pair positioned near an end of the handguard and each pair spaced apart from the other pair. The tabs may be positioned in different locations and in other embodiments. The tabs may be more than two pairs of tabs located on the handguard. The tabs may be more or less than a pair of tabs, for example, the tabs may be one, three, four, five or more located near the ends of the handguard, or located at different locations along the handguard. The tabs may be axially aligned with each other, or in other words, aligned along the axial direction. The tabs may also be non-axially aligned depending on the shape and configuration of the forearm or forestock 20. As with the other embodiments, the tabs 39 may be differently configured, shaped, and/or positioned, and the handguard 30 may have a greater or smaller number of tabs 39, as indicated above. In a further aspect, the tabs 39 may include additional retaining structure, such as clasps, hooks, lips, rubber grommets 439, rubber o-rings, etc., located on and/or around the tabs, and some or all of such structure may be flexible and/or resilient.

Figure 45:
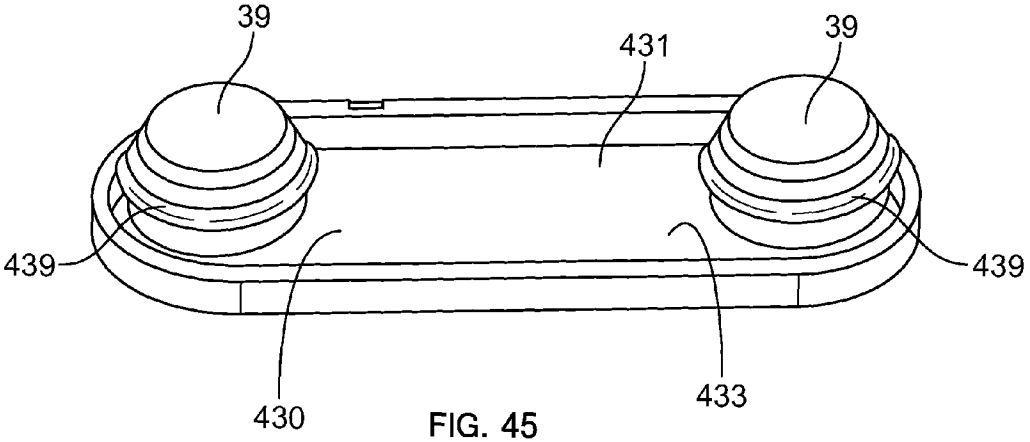
FIG. 45 is a bottom view of another exemplary handguard.

In one embodiment, the grommet 439 may be in the form of a rubber ring that is positioned around the tab and located approximately at the midpoint between the bottom of the tab and the top or outer edge of the tab. The grommet 439 extends around the periphery of the tab, as shown in FIG. 45, and may seat within a channel or recess formed within the annular wall of the tab. The grommet 439 may seat within the channel such that part of the thickness of the grommet extends outwardly from the annular wall. In one embodiment, the grommet 439 will extend outwardly from the annular wall approximately one-half the thickness of the grommet ring. The grommet may extend outwardly from the tab a greater or lesser extent. The rubber permits the grommet to be flexible in stretching to fit onto the annular tab and in contracting to seat within the channel formed in the annular wall of the tab. The grommet 439 may function as a retaining structure to assist in holding the handguard to the slots formed on the forearm.

In one embodiment, when the tab is inserted into the slot or hole, the grommet will compress to permit the tab to be fully inserted into the slot or hole. Once fully inserted, the rubber grommet will flex back to its original shape and the thickness of the grommet extending outwardly from the annular wall of the tab will serve as a catch to the underneath side of the slot or hole thereby holding the handguard to the slot or hole and thus to the forearm. The handguard can be removed and relocated by lifting up on the handguard with sufficient force to cause the grommet ring to compress thereby allowing the grommet and tab to pass back out of the slot or hole. It should be understood that the retaining structure may include additional and/or different types of retaining structure in other embodiments. For example, the retaining structure may include flanges, ridges, moveable fasteners or connectors, or other connecting structure, as well as bracing structures that create additional points of contact to stabilize the connection between the handguard 430 and the firearm 10.

The handguard 430 illustrated in FIGS. 40-45 can be connected to the forearm 20 of the firearm 10 by positioning the handguard 430 along the forearm 20 and inserting the tabs 39 in the slots 25 in the forearm 20 which connects the handguard 430 to the forearm 20. In an exemplary aspect, the slots 25 are dimensioned and contoured in a complementary manner with the tabs 39, to resist movement of the handguard 30 in any direction once connected. The slots 25 may be circular, elongated or key-shaped. The tabs 39 may flex or deform slightly during insertion into the slots 25. In an alternative aspect, one or more screws or other fasteners may additionally be used to secure the connection between the handguard 430 and the forearm 20. The handguard may also be connected to the forearm of the firearm with another connections and configurations. It is understood that the body 431 of the handguard 430 may have some degree of flexibility or resiliency, such that the body 431 can be bent to facilitate the insertion of the tabs into the slots in the forearm 20.

Multiple handguard 430 may be mounted to the forearm 20. Depending on the size of the handguard used, one, two, three, four, five or more handguards may be positioned around the forearm 20. The handguards may also be cut to a desirable length, if it is desirable to have axially shorter handguards on the forearm. The handguards may be located at any desirable location around the forearm to provide the operator with the desired level of grip, comfort, aesthetics and functionality. In an alternative embodiment, any of the various handguards described herein may be located at other locations on the firearm, including the upper receiver, lower receiver, pistol grip and buttstock. The handguards may be mounted at these other locations using the same techniques described herein.

Figure 41:
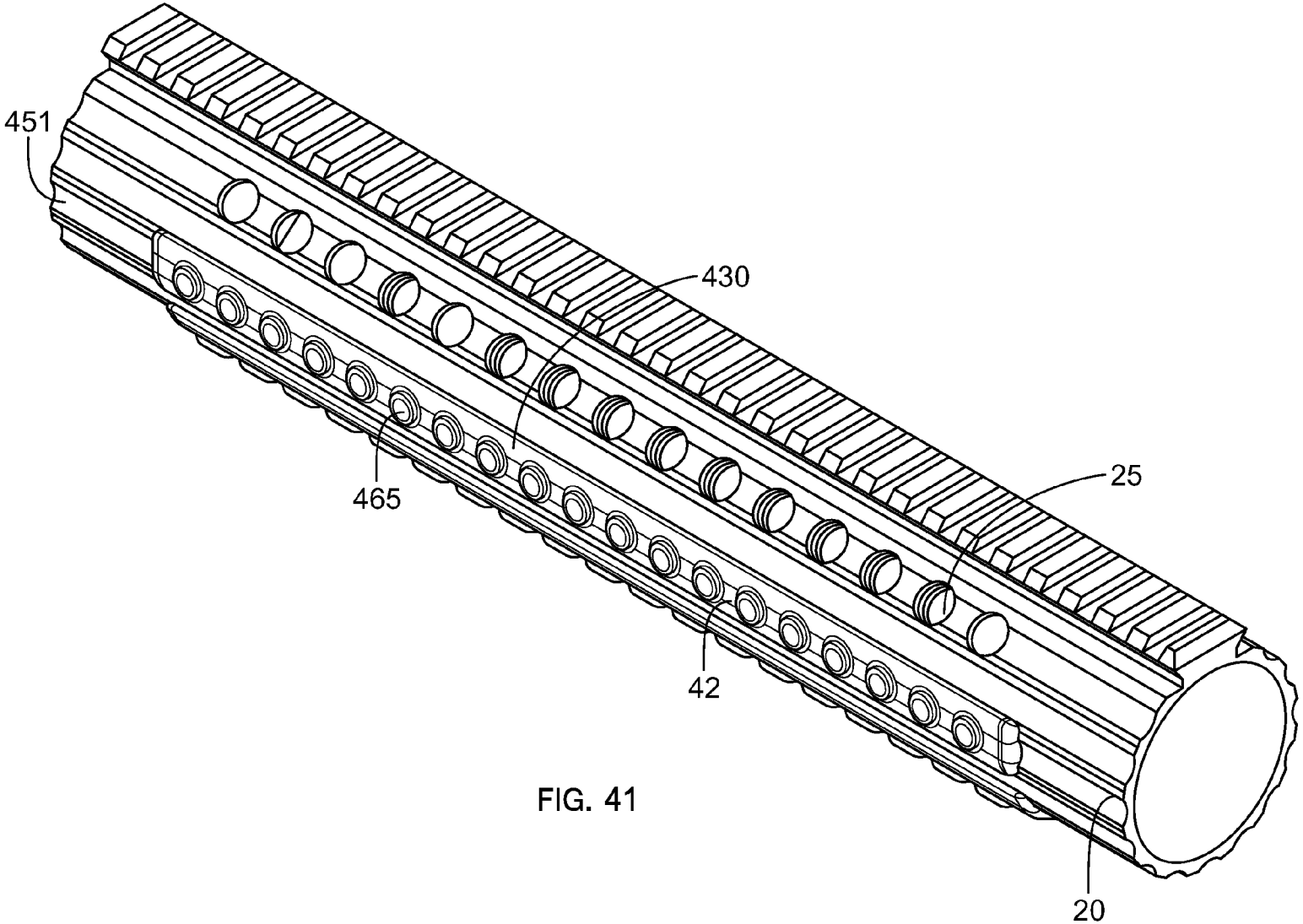
FIG. 41 is a perspective view of another exemplary handguard.

The elongated bump or ridge 448 that extends in the axial direction over at least a portion of the axial length of the body 431 may be used to align the handguard 430 with an elongated recess 451 formed in the forearm 20. For example, some forearms are fluted along their exterior surface, as shown in FIGS. 40-43. The fluted configuration extends over at least a portion of the axial length of the forearm. One or more fluted surfaces 451 may be located along the forearm. The bump or ridge 448 may be configured to align with and seat within the recessed or fluted surface 451 on the forearm 20. In this configuration, bump or ridge 448 assists in holding the handguard to the forearm by preventing rotational movement of the handguard relative to the forearm. In an exemplary aspect, one, two, three or more bumps or ridges may be circumferentially positioned on the handguard to assist in seating and holding the handguard to the forearm. The multiple bumps or ridges will form a wave-shaped cross section, as can be seen in FIGS. 42 and 43, in which the peaks of each wave will seat within the fluted surfaces on the forearm.

In an alternative aspect, rather than a single continuous bump or ridge along the axial length, the bump or ridge may be multiple bumps or ridges spaced apart and positioned axially along the length of the handguard. These multiple features will also assist in holding the handguard to the forearm in the same manner as a continuous bump or ridge. It is to be understood that other shapes, configurations, and locations of bumps or ridges may be used with the handguard of the invention.

The handguard 430 is removable from the forearm. The handguard 430 may be removed from the forearm 20 as desired by removing the tabs 39 from the slots 25, which may involve bending or flexing the body 431 and/or the tabs 39 to provide clearance. Removal may also require loosening and/or removal of any screw(s) or additional fastener(s) as described above. In another embodiment, the forearm 20 may include a different structure for connection to the handguard 430, and such structures may be complementary with the retaining structure on the handguard 430. In a further embodiment, the handguard 430 may be configured for connection to a different part of the firearm 10, such as in an embodiment where the firearm 10 does not have a forearm 20.

In one embodiment, the handguard 430 may have a mounting structure that may include one or more rails 40 thereon for mounting of accessories, as described above. The rails 40 may be Picatinny rails, although different types of rails or other mounting structures providing mounting functionality may be used, as described above.

The handguard 430 may also have a gripping portion or section 42 to provide a gripping surface for the user. In the embodiment in FIGS. 40-45, the body 431 of the handguard 430 has a gripping section 42 that extends along and occupies a portion of the axial length of the body 431. The gripping section 42 may have a smoothly curved and rounded outer surface (FIG. 40) to facilitate gripping, as well as a plurality of parallel, circumferential gripping ridges 444 (FIGS. 42-43) to enhance gripping. In an alternative configuration, the gripping section 42 may have a plurality of golf ball style dimples 461 (FIG. 42), or it may have a textured surface that forms a checkered pattern 463 (FIG. 43), or it may have a plurality of suction cup style recesses 465 (FIG. 41). The gripping section 42 may have a combination of these surface types and gripping ridges. The gripping section 42 may additionally or alternately include other structures and features, including different surface contours and shapes. For example, the gripping section 42 may include an integral grip, such as a contoured grip, a pistol grip, or other such structures providing gripping functionality. The gripping section may be integral with the body 431 or may be over-molded onto to the body. The gripping section may be made of the same material as the body, or it may be a different material, such as rubber.

The handguards 30, 130, 230, 330, 430 described herein may include visual effects that are applied to the handguard 30, 130, 230, 330. Such visual effects may be applied in the form of dyes or other colorants, paints, coatings, decals, or a combination of such visual effects. For example, the handguards 30, 130, 230, 330, 430 may be provided in a variety of different colors, including color patterns such as camouflage patterns or stylistic patterns or effects. As another example, the visual effects may include indicia, including words, numbers, symbols, etc. Such visual effects may be applied to the material itself, such as by using dyes or pigments to change the color of the material of the body 31 or a portion of the body 31. Such visual effects may additionally or alternately be applied to one or more surfaces of the body 31, such as an application of a coating on the outer surface 32 of the body 31. The use of such visual effects increases the user to change the appearance of a firearm 10 by connecting the handguard 30, 130, 230, 330, 430 to the firearm 10, or by removing one handguard 30, 130, 230, 330, 430 and replacing it with another handguard 30, 130, 230, 330, 430 with a different visual appearance.

The handguards 30, 130, 230, 330, 430 described herein may be formed of a variety of different materials, using a variety of different techniques. For example, the handguards 30, 130, 230, 330, 430 may be formed of a plastic/polymeric material, a metallic material, a polymer-composite material or other composite material (including wood), or other material. In one embodiment, a handguard 30, 130, 230, 330, 430 as described herein may be made from Nylon 6-6 or another Nylon or Nylon-based material. As described above, the material of the handguard 30, 130, 230, 330, 430 may be may have sufficient flexibility and/or resilience to flex slightly to permit the retaining tabs 39 to be inserted into and removed from the slots 39. Additionally, the material of the handguard 30, 130, 230, 330, 430 may be conducive to the application of different types of dyes or other visual effects. Handguards 30, 130, 230, 330, 430 may be manufactured using a variety of techniques, such as various casting and molding techniques, including liquid-based casting techniques, powder techniques, prepreg techniques, and other such techniques, as well as forging, extrusion, machining, and other techniques and combinations of such techniques. For example, the handguard 30, 130, 230, 330, 430 may be manufactured using one of the aforementioned techniques and then subjected to a post-machining process.

Each of the various embodiments of handguards 30, 130, 230, 330, 430 as described herein may contain any components, structures, or other features of any of the other embodiments described herein, including any variations, additional features, or alternative embodiments described herein, whether or not illustrated in the drawing figures.

The various embodiments of handguards 30, 130, 230, 330, 430 described herein provide benefits and advantages over existing firearm components. For example, at least some of the handguards 30, 130, 230, 330, 430 can provide a more effective gripping surface as compared to the forearm 20 where the user would normally grip. As another example, at least some of the handguards 30, 130, 230, 330, 430 can provide mounting rails 40 or other mounting structure(s), which allows a user to mount accessories in additional numbers and/or additional positions as compared to the firearm 10 without the handguard 30, 130, 230, 330, 430. As a further example, the handguards 30, 130, 230, 330, 430 can assist with heat dissipation and do not interfere with the free-floating configuration of the barrel 13. As yet another example, the handguards 30, 130, 230, 330, 430 can be used to provide visual effects that are desirable to the user, including camouflage or stylistic effects. Still further benefits and advantages are recognizable to those skilled in the art.

Several alternative embodiments and examples have been described and illustrated herein. A person of ordinary skill in the art would appreciate the features of the individual embodiments, and the possible combinations and variations of the components. A person of ordinary skill in the art would further appreciate that any of the embodiments could be provided in any combination with the other embodiments disclosed herein. It is understood that the invention may be embodied in other specific forms without departing from the spirit or central characteristics thereof. The present examples and embodiments, therefore, are to be considered in all respects as illustrative and not restrictive, and the invention is not to be limited to the details given herein. The terms "first," "second," "top," "bottom," etc., as used herein, are intended for illustrative purposes only and do not limit the embodiments in any way. Additionally, the term "plurality," as used herein, indicates any number greater than one, either disjunctively or conjunctively, as necessary, up to an infinite number. Further, "providing" an article or apparatus, as used herein, refers broadly to making the article available or accessible for future actions to be performed on the article, and does not connote that the party providing the article has manufactured, produced, or supplied the article or that the party providing the article has ownership or control of the article. Accordingly, while specific embodiments have been illustrated and described, numerous modifications come to mind without significantly departing from the spirit of the invention and the scope of protection is only limited by the scope of the accompanying Claims.

What is claimed is:

1. A removable handguard for a firearm, comprising:

a shell, the shell extending axially between first and second ends thereof and peripherally between first and second edges thereof around an angular range such that the shell has a concave inner surface and a convex outer surface extending between the first and second edges, the shell being configured to be connected to a forearm for the firearm by positioning the shell onto slots or openings formed in the forearm;

a first tab and a second tab located on the inner surface of the shell, each of the first and second tabs defining an annular wall and configured to releasably engage one or more of the slots or openings formed on the forearm and retain the shell in place on the forearm, wherein the releasable engagement permits removal of the shell from the forearm;

a rubber grommet positioned on an exterior surface of the annular wall of each of the first and second tabs; and a gripping section extending axially along an exterior of the shell and including a gripping member.

2. The removable handguard of claim 1, wherein the gripping member comprises a plurality of suction cup style recesses.

3. The removable handguard of claim 2, wherein the recesses are positioned in an axially extending row.

4. The removable handguard of claim 1, wherein the gripping member comprises a plurality of dimples.

5. The removable handguard of claim 4, wherein the dimples are arranged in an array of rows and columns.

6. The removable handguard of claim 1, wherein the gripping member comprises a plurality of parallel circumferential ridges.

7. The removable handguard of claim 1, wherein the gripping member comprises a textured surface.

8. The removable handguard of claim 7, wherein the textured surface has a checkered pattern.

9. The removable handguard of claim 1, wherein the gripping member includes a plurality of gripping sections and a plurality of parallel circumferential ridges, and wherein adjacent gripping sections are separated by one of the ridges.

10. The removable handguard of claim 9, wherein each gripping section includes an array of rows and columns of dimples.

11. The removable handguard of claim 9, wherein each gripping section includes a textured surface.

12. The removable handguard of claim 11, wherein the textured surface has a checkered pattern.

13. The removable handguard of claim 1, further comprising a third tab and a fourth tab positioned on the inner surface of the shell, the first, second, third and fourth tabs being aligned along a first linear axis, and wherein the third and fourth tabs are configured to be received in additional slots or openings in the forearm to removably connect the shell to the forearm.

14. The removable handguard of claim 1, further comprising a mounting structure connected to the shell and configured for mounting of an accessory.

15. The removable handguard of claim 1, further comprising a first rail connected to the outer surface of the shell and extending axially over at least a portion of an axial length of the shell, the first rail configured for mounting of an accessory.

16. The removable handguard of claim 1, further comprising a slot formed in the exterior surface of the annular wall of each tab;

wherein one of the rubber grommets is received in each slot.

17. The removable handguard of claim 1, further comprising a ridge on the inner surface of the shell and extending axially between the first end and the second end;

wherein the ridge is configured to engage an axially extending recess formed in the firearm.

18. The removable handguard of claim 1, further comprising at least one additional ridge on the inner surface of the shell and extending axially between the first end and the second end;

wherein each additional ridge is configured to engage an axially extending recess formed in the firearm.

19. A firearm comprising:

a receiver assembly;

a free-floating barrel connected to the receiver assembly;

a muzzle at the end of the barrel;

a forearm at least partially surrounding the barrel and positioned between the receiver assembly and the muzzle, the forearm having a plurality of slots around the forearm;

and the removable handguard of claim 1 removably connected to the forearm such that the first and second tabs are received in the slots to connect the removable handguard to the forearm.

20. A firearm comprising:

a receiver assembly;

a free-floating barrel connected to the receiver assembly;

a muzzle at the end of the barrel;

a forearm at least partially surrounding the barrel and positioned between the receiver assembly and the muzzle, the forearm having a plurality of openings around the forearm;

and the removable handguard of claim 1 removably connected to the forearm such that the first and second tabs are received in the openings to connect the removable handguard to the forearm.

* * * * *